US011056047B2

(12) United States Patent
Shigeta et al.

(10) Patent No.: US 11,056,047 B2
(45) Date of Patent: Jul. 6, 2021

(54) DISPLAY PANEL AND DRIVING METHOD OF THE DISPLAY PANEL

(71) Applicant: SAMSUNG ELECTRONICS CO., LTD., Suwon-si (KR)

(72) Inventors: Tetsuya Shigeta, Suwon-si (KR); Jinho Kim, Suwon-si (KR); Sangyoung Park, Suwon-si (KR); Hoseop Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/731,377

(22) Filed: Dec. 31, 2019

(65) Prior Publication Data

US 2020/0265777 A1 Aug. 20, 2020

(30) Foreign Application Priority Data

Feb. 20, 2019 (KR) ..... 10-2019-0019641

(51) Int. Cl.
*G09G 3/32* (2016.01)

(52) U.S. Cl.
CPC ..... *G09G 3/32* (2013.01); *G09G 2300/08* (2013.01); *G09G 2320/064* (2013.01); *G09G 2330/021* (2013.01)

(58) Field of Classification Search
CPC ..... G09G 3/32
USPC ..... 345/76, 101, 211, 691, 696; 702/107
See application file for complete search history.

(56) References Cited

U.S. PATENT DOCUMENTS 5,852,430 A * 12/1998 Endo ..... G09G 3/3607 345/101
7,277,072 B2 10/2007 Akimoto et al.
7,812,793 B2 10/2010 Steer
8,581,897 B2 * 11/2013 Park ..... H05B 45/60 345/211

(Continued)

FOREIGN PATENT DOCUMENTS

JP 2012-160287 A 8/2012
KR 10-2005-0075754 A 7/2005

(Continued)

OTHER PUBLICATIONS

International Search Report (PCT/ISA/210) dated Apr. 28, 2020 by the International Searching Authority in counterpart International Patent Application No. PCT/KR2020/000563.

(Continued)

*Primary Examiner* — Prabodh M Dharia
(74) *Attorney, Agent, or Firm* — Sughrue Mion, PLLC

(57) ABSTRACT

A display panel includes a plurality of pixels arranged in a matrix, the plurality of pixels respectively including a plurality of sub pixels. The plurality of sub pixels respectively includes a light emitting element, and a PWM pixel circuit configured to control a light emitting duration of the light emitting element, based on a pulse width modulation (PWM) data voltage and a sweep voltage. A plurality of PWM pixel circuits included in the display panel are driven, for each of row lines of the plurality of pixels, in an order of a data setting period for setting the PWM data voltage and then a light emitting period in which the light emitting element emits light during a duration corresponding to the set PWM data voltage according to a change of the sweep voltage.

20 Claims, 26 Drawing Sheets

(56) References Cited

U.S. PATENT DOCUMENTS

| | | | | |
|---|---|---|---|---|
| 9,489,886 | B2 | 11/2016 | Sarma et al. | |
| 9,697,766 | B2 | 7/2017 | Kikuchi et al. | |
| 10,593,251 | B2 * | 3/2020 | Shigeta | G09G 3/2018 |
| 10,713,996 | B2 * | 7/2020 | Kim | H01L 25/167 |
| 2005/0156832 | A1 * | 7/2005 | Ono | G09G 3/3258 345/76 |
| 2005/0197796 | A1 * | 9/2005 | Daigle | H03M 1/1028 702/107 |
| 2009/0115703 | A1 * | 5/2009 | Cok | G09G 3/3233 345/76 |
| 2014/0152709 | A1 * | 6/2014 | Kawae | G09G 3/3225 345/690 |
| 2018/0151125 | A1 | 5/2018 | Lee | |
| 2018/0182279 | A1 * | 6/2018 | Sakariya | G09G 3/2018 |
| 2018/0293929 | A1 | 10/2018 | Shigeta et al. | |
| 2018/0301080 | A1 * | 10/2018 | Shigeta | G09G 3/3208 |
| 2020/0312216 | A1 * | 10/2020 | Kim | G09G 3/2014 |

FOREIGN PATENT DOCUMENTS

| | | | | |
|---|---|---|---|---|
| KR | 10-2007-0099003 | A | 10/2007 | |
| KR | 10-2008-0063303 | A | 7/2008 | |
| KR | 62484971 | * | 4/2017 | G09G 3/2018 |
| KR | 10-2018-0061524 | A | 6/2018 | |
| KR | 10-2018-0114816 | A | 10/2018 | |
| WO | 2007/042973 | A1 | 4/2007 | |

OTHER PUBLICATIONS

Written Opinion (PCT/ISA/237) dated Apr. 28, 2020 by the International Searching Authority in counterpart International Patent Application No. PCT/KR2020/000563.

* cited by examiner

DISPLAY PANEL AND DRIVING METHOD OF THE DISPLAY PANEL

CROSS-REFERENCE TO RELATED APPLICATION

This application is based on and claims priority under 35 U.S.C. § 119 to Korean Patent Application No. 10-2019-0019641, filed on Feb. 20, 2019, in the Korean Intellectual Property Office, the disclosure of which is incorporated by reference herein in its entirety.

BACKGROUND

1. Field

The disclosure relates to a display panel and a driving method of the display panel, and more particularly, to a display panel driven by an active matrix (AM) method and a driving method of the display panel.

2. Description of Related Art

For conventional inorganic light emitting diode (LED) display panels, passive matrix (PM) driving was a mainstream technology, but in the case of PM driving, a light emission duty ratio is low. Thus, it is not appropriate for low power consumption. Accordingly, for low power consumption of an inorganic light emitting diode (LED) display panel, active matrix (AM) driving that uses a pixel circuit consisting of a transistor and/or a capacitor is needed.

As AM driving methods, there are a pulse amplitude modulation (PAM) method that expresses a gray scale with the amplitude of a driving current, and a pulse width modulation (PWM) method that expresses a gray scale with the driving time (or the pulse width) of a driving current. As PWM methods, there are a digital PWM method and an analog PWM method.

In the case of an inorganic LED display panel, there is a color shift phenomenon according to the size (or the amplitude) of a driving current due to the characteristic of an LED, and thus a PWM method is more appropriate than a PAM method.

In the case of a digital PWM method, as a gray scale is expressed by a sub field method, there is a problem of a false contour noise, and if the number of sub fields is increased for reducing the problem of a false contour noise, there is a problem that the light emission duty ratio is decreased.

An analog PWM method is a method of controlling turning-on/turning-off of a control transistor by moving a PWM data voltage that is set (or programmed) in a gate terminal of the control transistor up and down through an external sweep signal (e.g., a triangle wave), and in accordance thereto, controlling the driving time of a driving current (i.e., the light emitting time of a light emitting element).

As analog PWM methods, there are a method of using a complementary metal oxide semiconductor (CMOS) type transistor and a method of using a single type transistor of any one of an N-channel metal oxide semiconductor (NMOS) or a P-channel metal oxide semiconductor field (PMOS).

Here, a CMOS type transistor cannot be applied to an oxide thin film transistor (TFT), and even though it can be applied to a low temperature polycrystalline silicon (LTPS) TFT, there is a problem that the cost increases.

In the case of a method using a conventional single type transistor, setting (or programming) of a PWM data voltage that determines the turning-on/turning-off time of a light emitting element and light emission of a light emitting element according to a sweep signal cannot be performed simultaneously, and thus there is a limit to raising a light emission duty ratio.

SUMMARY

Provided are a display panel wherein a data voltage can be stably set and a high light emission duty ratio can be secured, and a driving method of the display panel.

Additional aspects will be set forth in part in the description that follows and, in part, will be apparent from the description, or may be learned by practice of the presented embodiments.

According to embodiments, a display panel includes a plurality of pixels arranged in a matrix, the plurality of pixels respectively including a plurality of sub pixels. The plurality of sub pixels respectively includes a light emitting element, and a PWM pixel circuit configured to control a light emitting duration of the light emitting element, based on a pulse width modulation (PWM) data voltage and a sweep voltage. A plurality of PWM pixel circuits included in the display panel are driven, for each of row lines of the plurality of pixels, in an order of a data setting period for setting the PWM data voltage and then a light emitting period in which the light emitting element emits light during a duration corresponding to the set PWM data voltage according to a change of the sweep voltage. The data setting period and the light emitting period are continuous in time, and the data setting period is driven sequentially for each of the row lines.

While a plurality of PWM pixel circuits corresponding to a first row line of the plurality of pixels operates in the light emitting period, a plurality of PWM pixel circuits corresponding to a second row line of the plurality of pixels may operate in the data setting period.

A sum of a time period of the data voltage setting period and a time period of the light emitting period may be a time period of one image frame, and a total time period in which all row lines of the plurality of pixels are driven once may exceed the time period of the one image frame.

The PWM pixel circuit may include a control transistor configured to be turned on and off, based on the PWM data voltage and the sweep voltage, to control the light emitting duration of the light emitting element based on a turning-on and off operation of the control transistor. A gate terminal voltage of the control transistor may be set as a first voltage, based on the PWM data voltage and the sweep voltage during the data setting period, and The gate terminal voltage of the control transistor may change according to the change of the sweep voltage during the light emitting period, so that the control transistor is turned on during a time period corresponding to the PWM data voltage.

The control transistor may be an N-channel metal oxide semiconductor field effect transistor (NMOSFET), and a source terminal of the control transistor may be connected to a ground voltage terminal. The PWM pixel circuit may further include a first transistor connected between a drain terminal of the first transistor and a gate terminal of the control transistor, a first capacitor including a first end connected to the drain terminal of the first transistor and the gate terminal of the control transistor, a second transistor including a drain terminal connected to a data line to which the PWM data voltage is applied, and a source terminal connected to a second end of the first capacitor, a third transistor including a source terminal connected to the drain terminal of the first transistor, the gate terminal of the control transistor, and the first end of the first capacitor, and a drain terminal to which an initial voltage is applied, a fourth transistor including a drain terminal to which the sweep voltage is applied, and a source terminal connected to the second end of the first capacitor and the source terminal of the second transistor, and a fifth transistor including a drain terminal connected to a cathode terminal of the light emitting element, and a source terminal connected to the source terminal of the first transistor and the drain terminal of the control transistor. An anode terminal of the light emitting element may be connected to a driving voltage terminal.

The gate terminal voltage of the control transistor in the data setting period may become the initial voltage through the third transistor being turned on based on a second driving signal, while the fourth transistor is turned off based on a first driving signal, may become a second voltage from the initial voltage, while the third transistor is turned off based on the second driving signal and the first transistor and the second transistor are turned on based on a third driving signal, and may be set as the first voltage from the second voltage, based on the first transistor and the second transistor being turned off according to the third driving signal and the fourth transistor being turned on according to the first driving signal. The first voltage may be reduced from the second voltage as much as a difference value between the PWM data voltage and a sweep voltage at a time point when the fourth transistor is turned on, and the second voltage may be a sum of a ground voltage of the ground voltage terminal and a threshold voltage of the control transistor.

The fourth transistor may be configured to, in the light emitting period, maintain a turned-on state, based on the first driving signal, and the gate terminal voltage of the control transistor, in the light emitting period, may change from the first voltage, based on the sweep voltage applied through the turned-on fourth transistor.

The control transistor may be configured to, in the light emitting period, be turned on in a time in which a gate voltage of the gate terminal that changes based on the sweep voltage is higher than the second voltage, and the light emitting element may be configured to, in the light emitting period, emit light, based on a driving current that flows through the control transistor while the control transistor is turned on.

The PWM pixel circuit may further include a constant current source configured to provide a driving current of a regular amplitude to the light emitting element, and the drain terminal of the fifth transistor may be connected with the cathode terminal of the light emitting element through the constant current source, and the fifth transistor is turned on during the light emitting period according to the first driving signal.

The drain terminal of the third transistor may be connected with the data line, and the initial voltage may be the PWM data voltage.

The display panel may further include a pulse amplitude modulation (PAM) driving circuit configured to control an amplitude of a driving current that is provided to the light emitting element, based on a PAM data voltage.

The control transistor may be a P-channel metal oxide semiconductor field effect transistor (PMOSFET), and a source terminal of the control transistor is connected to a driving voltage terminal, and the PWM pixel circuit may further include a sixth transistor connected between a drain terminal and a gate terminal of the control transistor, a second capacitor including a first end connected to a source terminal of the sixth transistor and the gate terminal of the control transistor, a seventh transistor including a source terminal connected to a data line to which the PWM data voltage is applied, and a drain terminal connected to a second end of the second capacitor, an eighth transistor including a drain terminal connected to the source terminal of the sixth transistor, the gate terminal of the control transistor, and the first end of the second capacitor, and a source terminal to which an initial voltage is applied, a ninth transistor including a source terminal to which the sweep voltage is applied, and a drain terminal connected to the second end of the second capacitor and the drain terminal of the seventh transistor, and a tenth transistor including a drain terminal connected to an anode terminal of the light emitting element, and a source terminal connected to the drain terminal of the sixth transistor and the drain terminal of the control transistor. A cathode terminal of the light emitting element may be connected to a ground voltage terminal.

The gate terminal voltage of the control transistor in the data setting period may become the initial voltage through the eighth transistor being turned on based on a fifth driving signal, while the ninth transistor is turned off based on a fourth driving signal, become a third voltage from the initial voltage, while the eighth transistor is turned off based on the fifth driving signal and the sixth transistor and the seventh transistor are turned on based on a sixth driving signal, and may be set as the first voltage from the third voltage, based on the sixth transistor and the seventh transistor being turned off according to the sixth driving signal and the ninth transistor being turned on according to the fourth driving signal. The first voltage may be raised from the third voltage as much as a difference value between the PWM data voltage and a sweep voltage at a time point when the ninth transistor is turned on, and the third voltage may be a value of subtracting a threshold voltage of the control transistor from a driving voltage of the driving voltage terminal.

The ninth transistor may be configured to, in the light emitting period, maintain a turned-on state, based on the fourth driving signal, and the gate terminal voltage of the control transistor, in the light emitting period, may change from the first voltage, based on the sweep voltage applied through the turned-on ninth transistor.

The control transistor may be configured to, in the light emitting period, be turned on in a time period in which a gate voltage of the gate terminal that changes based on the sweep voltage is lower than the third voltage, and the light emitting element may be configured to emit light, based on a driving current that flows through the control transistor while the control transistor is turned on.

The sweep voltage may be a periodic signal in one time period of one image frame, and continuously change during the one time period.

According to embodiments, a driving method of a display panel is provided. The display panel includes a plurality of pixels arranged in a matrix, the plurality of pixels respectively including a plurality of sub pixels respectively. The plurality of sub pixels respectively may include a light emitting element, and a PWM pixel circuit configured to control a light emitting duration of the light emitting element, based on a pulse width modulation (PWM) data voltage and a sweep voltage. The driving method may include driving a plurality of PWM pixel circuits included in the display panel, for each of row lines of the plurality of pixels, in an order of a data setting period for setting the PWM data voltage and then a light emitting period in which the light emitting element emits light during a duration corresponding to the set PWM data voltage according to a change of the sweep voltage. The data setting period and the light emitting period may be continuous in time, and the data setting period may be driven sequentially for each of the row lines.

The driving may include driving a plurality of PWM pixel circuits corresponding to a first row line of the plurality of pixels, in the light emitting period, and while the plurality of PWM pixel circuits corresponding to the first row line are driven in the light emitting period, driving a plurality of PWM pixel circuits corresponding to a second row line of the plurality of pixels in the data setting period.

A sum of a time period of the data voltage setting period and a time period of the light emitting period may be a time period of one image frame, and a total time period in which all row lines of the plurality of pixels may be driven once exceeds the time period of the one image frame.

According to embodiments, a display panel includes a plurality of pixels arranged in a matrix, the plurality of pixels respectively including a plurality of sub pixels. The plurality of sub pixels may include a first plurality of light emitting elements in a first row line of the plurality of pixels, a first PWM pixel circuit configured to, based on a change of a sweep voltage, set a pulse width modulation (PWM) data voltage in a first time period, and control the first plurality of light emitting elements to emit first light in a second time period corresponding to the PWM data voltage set in the first time period, the second time period being continuously after the first time period, a second plurality of light emitting elements in a second row line of the plurality of pixels, a second PWM pixel circuit configured to, while the first plurality of light emitting elements are being controlled to emit the first light in the second time period, set the PWM data voltage in a third time period, and control the second plurality of light emitting elements to emit second light in a fourth time period corresponding to the PWM data voltage set in the third time period, the fourth time period being continuously after the third time period.

BRIEF DESCRIPTION OF THE DRAWINGS

The above and other aspects, features, and advantages of embodiments of the disclosure will be more apparent from the following description taken in conjunction with the accompanying drawings, in which.

DETAILED DESCRIPTION

According to embodiments, a display panel wherein a data voltage can be stably set and a high light emission duty ratio can be secured, and a driving method of the display panel can be provided. Accordingly, low power consumption in various types of display panels such as an inorganic LED display panel becomes possible.

In explaining the disclosure, in case it is determined that detailed explanation of related known technologies may unnecessarily confuse the gist of the disclosure, the detailed explanation will be omitted. Also, overlapping explanation about the same components will be omitted as much as possible.

The suffix "part" for components used in the following description is provided or interchangeably used in consideration of only easiness of drafting the specification, and does not have meaning or a function of itself distinguishing it from other components.

The terms used in the disclosure are used to explain the embodiments, and are not intended to restrict and/or limit the disclosure. Also, singular expressions include plural expressions, unless defined obviously differently in the context.

Also, in the disclosure, terms such as 'include' and 'have' may be construed as designating that there are such characteristics, numbers, steps, operations, elements, components or a combination thereof described in the specification, but not as excluding in advance the existence or possibility of adding one or more of other characteristics, numbers, steps, operations, elements, components or a combination thereof.

In addition, the expressions "first," "second" and the like used in the disclosure may be used to describe various elements regardless of any order and/or degree of importance. Also, such expressions are used only to distinguish one element from another element, and do not limit the elements.

Further, the description in the disclosure that one element (e.g., a first element) is "(operatively or communicatively) coupled with/to" or "connected to" another element (e.g., a second element) may be interpreted to include both the case in which the one element is directly coupled to the another element, and the case in which the one element is coupled to the another element through still another element (e.g., a third element). In contrast, the description that one element (e.g., a first element) is "directly coupled" or "directly connected" to another element (e.g., a second element) can be interpreted to mean that still another element (e.g., a third element) does not exist between the one element and the another element.

Also, the terms used in the embodiments of the disclosure may be interpreted as meanings generally known to those of ordinary skill in the art described in the disclosure, unless defined differently in the disclosure.

Hereinafter, various embodiments of the disclosure will be described in detail with reference to the accompanying drawings.

Figure 1:
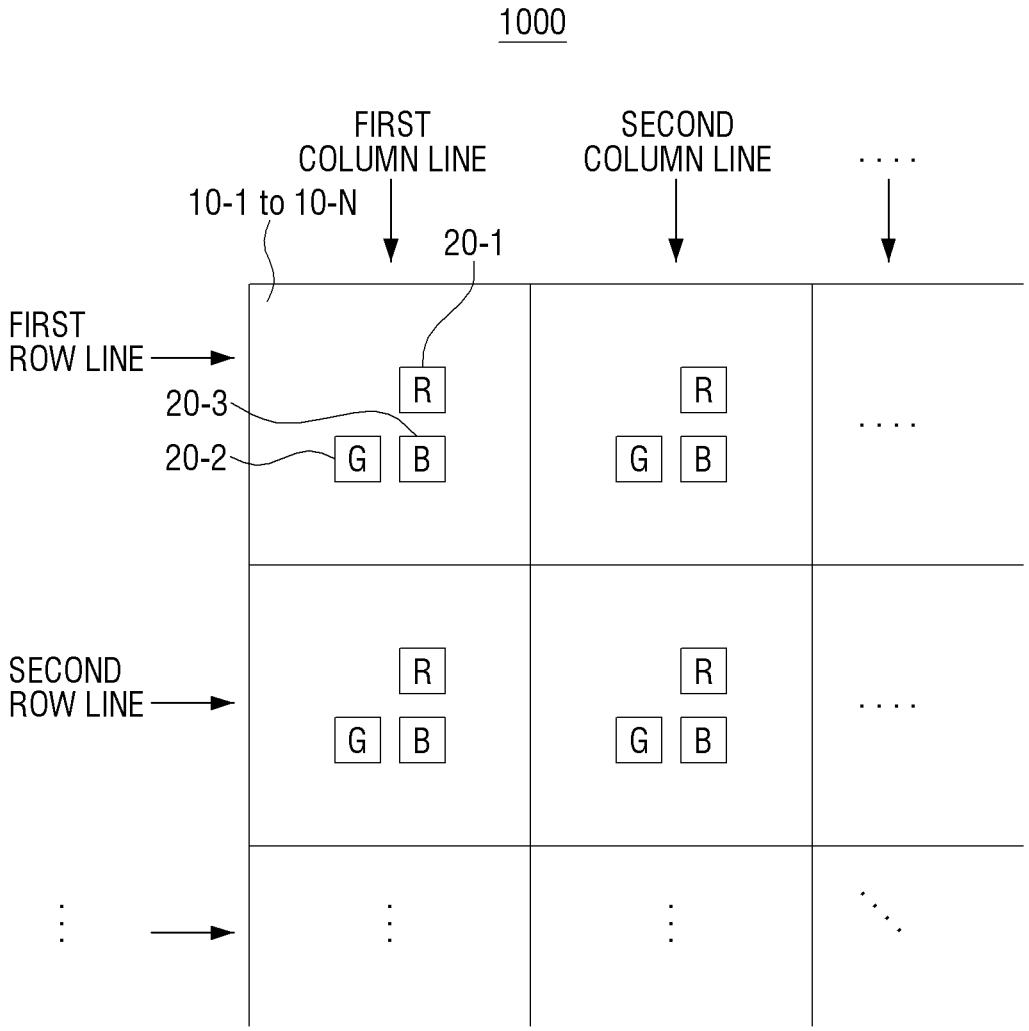
FIG. 1 is a plan view of a display panel for illustrating a pixel configuration of the display panel according to embodiments.

FIG. 1 is a plan view of a display panel 1000 for illustrating a pixel configuration of the display panel 1000 according to embodiments.

As illustrated in FIG. 1, the display panel 1000 may include a plurality of pixel areas 10-1 to **10-*n*** arranged in the form of a matrix. Here, the matrix form may include a plurality of row lines or a plurality of column lines. A row line may otherwise be referred to as a horizontal line or a scan line, and a column line may otherwise be referred to as a vertical line or a data line.

In each pixel area 10-1 to **10-*n*, three types of sub pixels such as a red (R) sub pixel 20-1, a green (G) sub pixel 20-2, and a blue (B) sub pixel 20-3 are included, and the R, G, and B sub pixels included in each pixel area 10-1 to 10-*n* constitute one pixel of the display panel 1000**.

Accordingly, according to embodiments, a plurality of pixels included in the display panel 1000 respectively include a plurality of sub pixels (three sub pixels such as R, G, and B in the example of FIG. 1), and they may be disposed or arranged in the form of a matrix inside the display panel 1000.

Here, each sub pixel 20-1 to 20-3 may include a light emitting element corresponding to the type of the sub pixel and a pulse width modulation (PWM) pixel circuit controlling the light emitting duration of the light emitting element. That is, the R sub pixel 20-1 may include an R light emitting element and a PWM pixel circuit controlling the light emitting duration of the R light emitting element, the G sub pixel 20-2 may include a G light emitting element and a PWM pixel circuit controlling the light emitting duration of the G light emitting element, and the B sub pixel 20-3 may include a B light emitting element and a pixel circuit controlling the light emitting duration of the B light emitting element, respectively.

Each PWM pixel circuit controls the driving time of a corresponding light emitting element based on the applied PWM data voltage and sweep voltage. A detailed content in this regard will be described later.

In the pixel configuration of the display panel 1000 as above, a plurality of PWM pixel circuits included in the display panel 1000 may be driven in the order of a data setting period and a light emitting period for each row line of the plurality of pixels.

Here, a data setting period is a period for setting or programming an applied PWM data voltage to a PWM pixel circuit, and a light emitting period is a period wherein a light emitting element emits light during a time period corresponding to the set PWM data voltage according to the change of the sweep voltage.

A data setting period and a light emitting period are continuous in time, and a PWM data voltage is applied to a PWM pixel circuit for each row line.

Accordingly, according to embodiments, while PWM pixel circuits included in a first row line among a plurality of PWM pixel circuits included in the display panel 1000 operate in a light emitting period, PWM pixels included in a second row line may operate in a data setting period.

That is, according to embodiments, when a display panel is driven, setting (or programming) of PWM data and light emission of a light emitting element can be performed at the same time, and thus a light emission duty ratio of a light emitting element can be drastically raised, and at the same time, stable data programming becomes possible.

In FIG. 1, an embodiment wherein sub pixels 20-1 to 20-3 are arranged in the form of the alphabet L with its right and left sides changed in one pixel area was suggested as an example. However, embodiments are not limited thereto, and the R, G, and B sub pixels 20-1 to 20-3 may be arranged in a row in a pixel area, or arranged in various forms depending on embodiments.

Also, in FIG. 1, explanation was made based on an example wherein three types of sub pixels constitute one pixel. However, depending on embodiments, four types of sub pixels such as R, G, B, and W (white) may constitute one pixel, or sub pixels in numerous different numbers may constitute one pixel.

Figure 2:
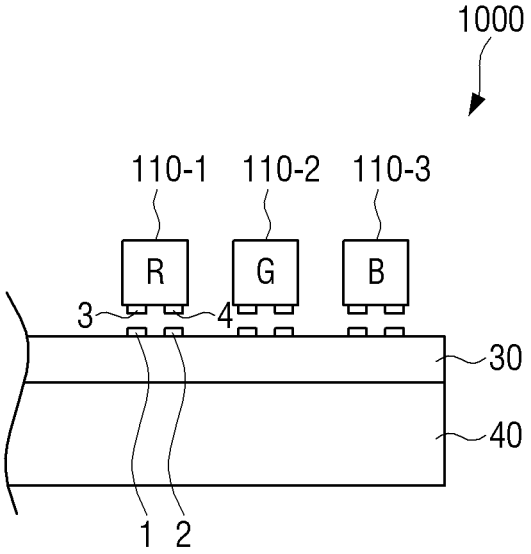
FIG. 2 is a cross-sectional view of the display panel of FIG. 1.

FIG. 2 is a cross-sectional view of the display panel 1000 of FIG. 1. In FIG. 2, for the convenience of explanation, only one pixel included in the display panel 1000 was illustrated, but the display panel 1000 obviously includes a plurality of pixels as in FIG. 1.

According to FIG. 2, the display panel 1000 includes a substrate 40, a thin film transistor (TFT) layer 30, and light emitting elements R, G, and B 110-1 to 110-3. Each of the light emitting elements R, G, and B 110-1 to 110-3 is arranged on the TFT layer 30 and constitutes each sub pixel 20-1 to 20-3 of the display panel 1000.

The substrate 40 may be implemented as synthetic resin or glass, etc., and depending on embodiments, it may be implemented as a hard material or a flexible material.

The TFT layer 30 may be any type such as an amorphous silicon (a-si) type, a low temperature poly silicon (LTPS) type, an oxide type, an organic type, etc.

In the TFT layer 30, pixel circuits for driving the light emitting elements 110-1 to 110-3 exist for each of the light emitting elements 110-1 to 110-3. Here, in the pixel circuits, a pulse amplitude modulation (PAM) pixel circuit for controlling the size (or the amplitude) of a driving current provided to a light emitting element and a pulse width modulation (PWM) pixel circuit for controlling the pulse width (or the duty ratio or the driving time) of a driving current provided to a light emitting element may be included.

Each of the light emitting elements R, G, and B 110-1 to 110-3 may be mounted or arranged on the TFT layer 30 such that they are electronically connected to corresponding pixel circuits. For example, as illustrated in FIG. 2, the R light emitting element 110-1 may be mounted or arranged such that the anode electrode 3 and the cathode electrode 4 of the R light emitting element 110-1 are respectively connected to the anode electrode 1 and the cathode electrode 2 formed on the pixel circuit corresponding to the R light emitting element 110-1, and this is also the same for the G light emitting element 110-2 and the B light emitting element 110-3. Depending on embodiments, one of the anode electrode 1 or the cathode electrode 2 may be implemented as a common electrode.

As illustrated in FIG. 2, according to embodiments, the light emitting elements 110-1 to 110-3 directly constitute the sub pixels of the display panel 1000. In this case, the light emitting elements 110-1 to 110-3 may be inorganic light emitting diodes (inorganic LEDs) or organic light emitting diodes (OLEDs).

Depending on embodiments, the display panel 1000 may further include a MUX circuit for selecting any one of the plurality of sub pixels 20-1 to 20-3 constituting one pixel, an electro static discharge (ESD) circuit for preventing static electricity generated at the display panel 1000, a power circuit for providing power to a pixel circuit, a clock providing circuit for providing a clock driving a pixel circuit, at least one gate driver for driving the pixels of the display panel 1000 arranged in the form of a matrix by row line units (or row units), a data driver (or a source driver) for providing a data voltage (e.g., a PAM data voltage or a PWM data voltage, etc.) to each pixel or each sub pixel, etc.

Figure 3:
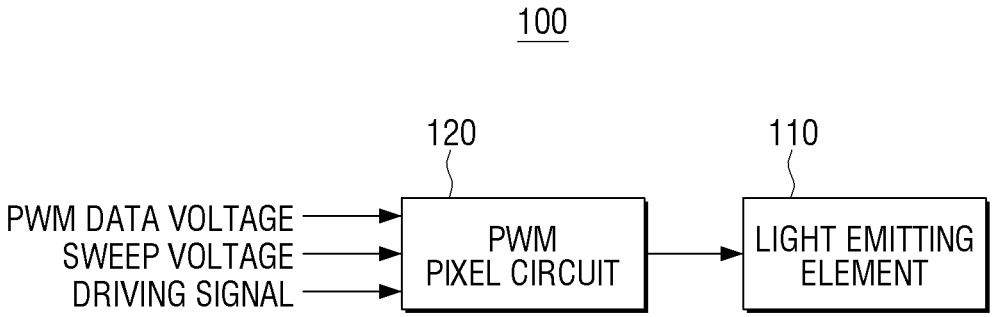
FIG. 3 is a block diagram schematically illustrating a configuration of a sub pixel included in a display panel according to embodiments.

FIG. 3 is a block diagram schematically illustrating a configuration of a sub pixel 100 included in a display panel according to embodiments. According to FIG. 3, a sub pixel 100 includes a light emitting element 110 and a PWM pixel circuit 120.

The light emitting element 110 constitutes the sub pixels 20-1 to 20-3 of the display panel 1000, and there may be a plurality of types of them according to the colors of the lights they emit. For example, in the light emitting elements 110, there may be a red (R) light emitting element emitting a light of a red color, a green (G) light emitting element emitting a light of a green color, and a blue (B) light emitting element emitting a light of a blue color.

Accordingly, types of the sub pixels may be determined according to the types of the light emitting elements 200. That is, an R light emitting element may constitute an R sub pixel 20-1, a G light emitting element may constitute a G sub pixel 20-2, and a B light emitting element may constitute a B sub pixel 20-3.

Here, the light emitting element 110 may be an organic light emitting diode (OLED) that is manufactured by using an organic material or an inorganic LED that is manufactured by using an inorganic material. Here, an inorganic LED may be a flip chip type, or it may be a lateral type or a vertical type.

The light emitting element 110 may be a micro light emitting diode (LED) (μ-LED) among inorganic LEDs. A micro LED refers to an ultra mini inorganic light emitting element of a size smaller than or equal to 100 micrometers (μm) that emits light by itself without a backlight or a color filter.

The light emitting element 110 emits light according to a driving current provided by the PWM pixel circuit 120. The light emitting element 110 emits light during a driving time of a driving current provided by the PWM pixel circuit 120. Here, a driving time of a driving current may also be expressed as a duty ratio of a driving current or a pulse width of a driving current.

For example, the light emitting element 110 may indicate a gray scale of higher luminance as a driving time of a driving current provided by the PWM pixel circuit 120 is longer (or as a duty ratio is higher or a pulse width is longer), but the disclosure is not limited thereto.

The PWM pixel circuit 120 drives the light emitting element 110. The PWM pixel circuit 120 may pulse width modulation (PWM) drive the light emitting element 110 to control the gray scale of the light emitted by the light emitting element 110.

That is, the PWM pixel circuit 120 may, for example, receive a PWM data voltage from a data driver, and provide a driving current having a pulse width controlled according to the applied PWM data voltage to the light emitting element 110, and thereby drive the light emitting element 110.

The PWM pixel circuit 120 may set (or program) a PWM data voltage by operating according to various types of driving signals that will be described later, and provide a driving current having a driving time (or a pulse width) corresponding to the set PWM data voltage to the light emitting element 110 according to the change of the sweep voltage.

A PWM driving method is a method of expressing a gray scale according to the light emitting duration of the light emitting element 110. In case the light emitting element 110 is driven by a PWM method, various gray scales may be expressed by varying the pulse width even if the amplitude of the driving current is the same. Accordingly, according to embodiments, the problem of a color shift that may occur in the case of driving an LED (or a micro LED) only by a PAM method of expressing a gray scale according to the amplitude of a driving current can be overcome.

Figure 4:
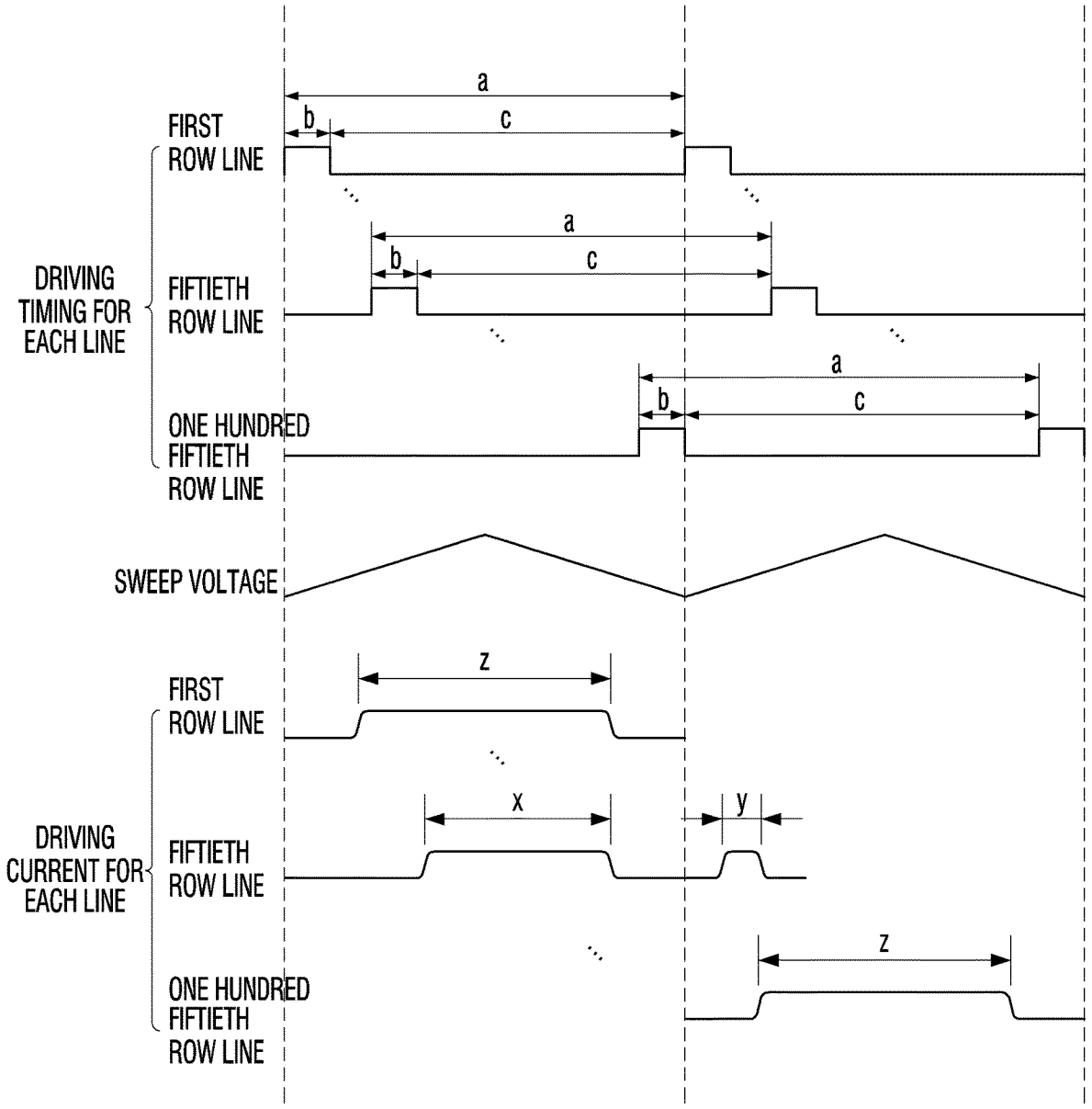
FIG. 4 is a diagram for illustrating a driving method of a display panel according to embodiments.

FIG. 4 is a diagram for illustrating a driving method of a display panel according to embodiments. In FIG. 4, a case wherein the display panel 1000 consists of 150 row lines was suggested as an example, but embodiments are not limited thereto.

In FIG. 4, driving timing for each line illustrates driving timing for each row line of a plurality of pixels arranged in the form of a matrix. Here, "a" indicates the time period of one image frame, "b" indicates a data setting period, and "c" indicates a light emitting period.

Each row line of the display panel 1000 includes a plurality of pixels, and each of the plurality of pixels includes a plurality of sub pixels 100. Thus, the fact that the display panel 1000 is driven for each row line means that a plurality of PWM pixel circuits 120 included in the display panel 1000 are driven for each row line.

According to embodiments, the plurality of PWM pixel circuits 120 included in the display panel 1000 may be driven in the order of a data setting period b and a light emitting period c for each row line, as illustrated in FIG. 4. Here, the data setting period b is a time period for setting or programming an applied PWM data voltage to the PWM pixel circuit 120, and the light emitting period c is a time period wherein the light emitting element 110 emits light during a duration corresponding to the set PWM data voltage according to the change of the sweep voltage.

The data setting period b and the light emitting period c as described above are continuous in time in one image frame a. That is, when PWM data setting is completed, the PWM pixel circuits 120 included in each line continuously operate in the light emitting period c in no time.

A PWM data voltage is applied to the PWM pixel circuit 120 during the data setting period b. As illustrated in FIG. 4, according to embodiments, the data setting period b proceeds sequentially for each row line. Thus, a PWM data voltage is also applied to the PWM pixel circuit 120 sequentially for each row line.

As described above, according to embodiments, the data setting period b and the light emitting period c that are continuous in time are driven sequentially for each row line. Thus, while one line among a plurality of row lines of the display panel 1000 (to be exact, PWM pixel circuits included in the one row line) operates in the light emitting period c, other row lines (to be exact, PWM pixel circuits included in the other row lines) may operate in the data setting period b.

For example, referring to the driving timing for each line illustrated in FIG. 4, it can be seen that the data setting period b of the fiftieth row line is included in the light emitting period c of the first row line.

A period of a sweep voltage is the time period a of one image frame, and the sweep signal may be a periodic signal that continuously changes during the period. Here, to the entire PWM pixel circuits 120 included in the display panel 1000, sweep voltage of the same waveform may be applied simultaneously. Alternatively, depending on embodiments, it is possible that sweep voltage of the same waveform are applied at different time points for each row line.

The driving currents for each line illustrate driving currents flowing in each row line of the display panel 1000. In FIG. 4, for the convenience of understanding, a case wherein the same PWM data voltages were applied to all of the plurality of PWM pixel circuits 120 included in each row line was assumed.

A PWM data voltage defines the driving time (or the pulse width) of a driving current. Thus, if the PWM data voltages are the same, the PWM pixel circuits 120 respectively provide a driving current having the same driving time (or the pulse width) to corresponding light emitting elements 110. In this case, each light emitting element 110 emits light during the same duration in the light emitting period c of each row line.

Referring to FIG. 4, PWM pixel circuits included in the first row line provide a driving current of which driving time is z to each corresponding light emitting element in the light emitting period of the first row line. Also, PWM pixel circuits included in the fiftieth row line provide a driving current of which driving time is x and a driving current of which driving time is y to each corresponding light emitting element in the light emitting period of the fiftieth row line. In addition, PWM pixel circuits included in the one hundred fiftieth row line provide a driving current of which driving time is z to each corresponding light emitting element in the light emitting period of the one hundred fiftieth row line. Here, the sum of x and y will be z.

Embodiments are not limited to the above cases. To the PWM pixel circuits included in the display panel 1000, PWM data voltages different from one another may be applied. Accordingly, each PWM pixel circuit may provide driving currents having different driving time to each corresponding light emitting element in the light emitting period of the row line wherein it is included.

Figure 5A:
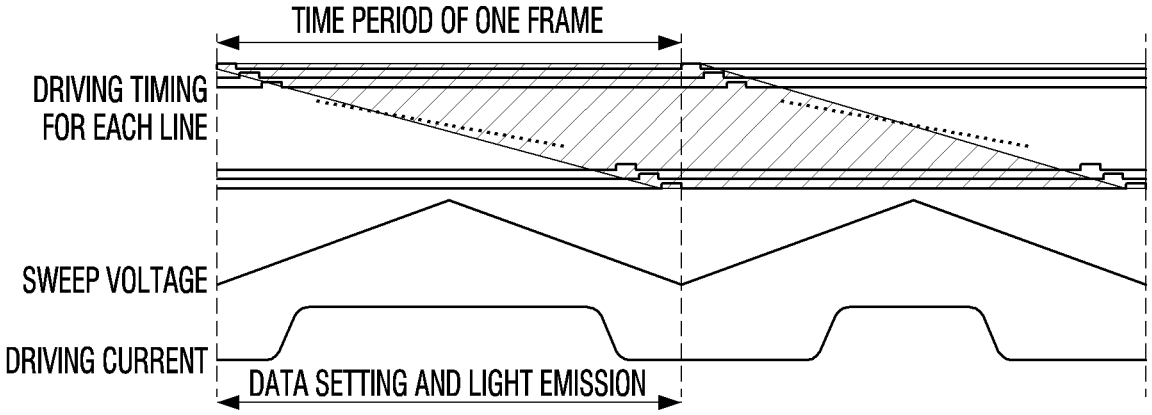
FIG. 5A is a diagram illustrating a driving method of a display panel according to embodiments.

FIG. 5A is a diagram illustrating a driving method of a display panel according to embodiments. FIG. 5A illustrates the driving timing for each row line included in the display panel 1000, and the sweep voltages and the driving currents applied to each row line while the display panel 1000 according to embodiments is driven during the time periods of two image frames.

As described above, the PWM pixel circuits included in each row line of the display panel 1000 are driven in the order of a data setting period b and a light emitting period c, and the sum of the data setting period b and the light emitting period c may be the time period a of one image frame.

Here, the data setting period of each row line may be driven sequentially during the time period of one frame, as illustrated in FIG. 5A. In this case, as a data setting period and a light emitting period are continuous time periods, the total time period wherein all row lines of the plurality of pixels arranged in the form of a matrix in the display panel 1000 are driven once may exceed the time period of one image frame. For example, the total time period wherein all row lines of the display panel 1000 are driven once may approximately be time periods of two image frames, as illustrated in FIG. 5A, but is not limited thereto. Depending on embodiments, the total time period wherein all row lines of the display panel 1000 are driven once may be set appropriately between a time period exceeding the time period of one image frame and a time period smaller than or equal to the time periods of two image frames.

Figure 5B:
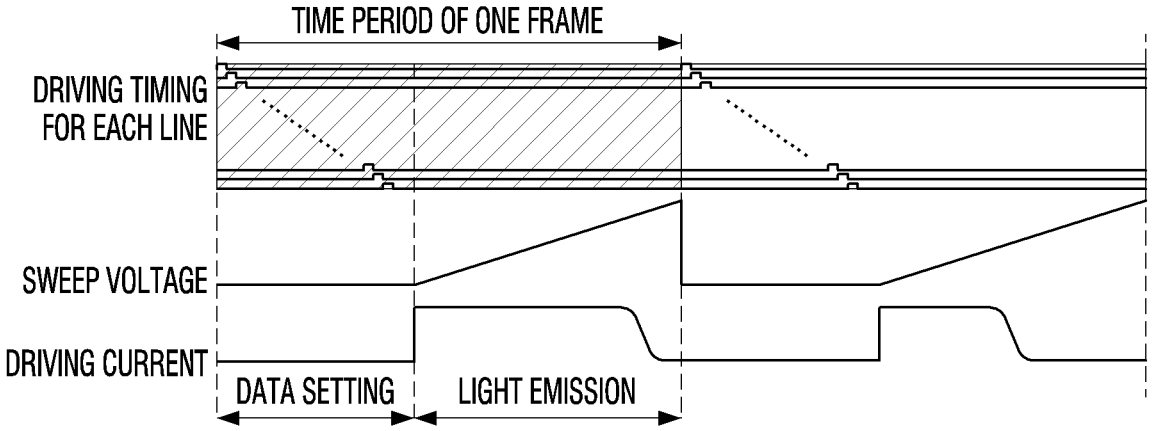
FIG. 5B is a diagram illustrating a driving method of a conventional display panel.

FIG. 5B is a diagram illustrating a driving method of a conventional display panel. FIG. 5B illustrates the driving timing for each row line, and the sweep voltages and the driving currents applied to each row line while a conventional display panel is driven during the time periods of two image frames.

As illustrated in FIG. 5B, in the case of a conventional technology, a data setting period and a light emitting period are not continuous in time. That is, in a conventional display panel, a data setting period and a light emitting period are driven while being distinguished for the entire row lines during the time period of one image frame.

Accordingly, for example, in the case of FIG. 5A, after a PWM data voltage is set during a data setting period, the plurality of PWM pixel circuits included in the first row line immediately operate in a light emitting period regardless of whether the data setting periods of the other lines proceed, but in the case of FIG. 5B, a light emitting period does not start immediately after PWM data is set, but a light emitting period proceeds simultaneously with all other row lines after data setting periods for all row lines proceed to the last row line.

The time period of one image frame is the same in all of the conventional technology and the embodiments of the disclosure. Accordingly, in the case of the conventional technology, a trade off relation exists between a data setting period and a light emitting period based on the time period of one image frame, and thus there is a limit to sufficiently securing a light emitting period.

However, in the case of the various embodiments of the disclosure, referring to the operation of the entire row lines based on the time period of one image frame, data setting and light emission of a light emitting element are possible at the same time (for example, while the second row line is operating in a data setting period, the first row line may operate in a light emitting period). Accordingly, a sufficiently long period of time may be allotted to data setting while a light emission duty ratio (=a ratio that a light emitting period occupies during the time period of one frame) is drastically raised to be close to approximately 100%.

Accordingly, according to the various embodiments of the disclosure, improvement of luminance or low power consumption of the display panel 1000 is possible, and at the same time, stable data setting (or programming) is possible even in case the setting time of a data voltage becomes longer as a panel load increases or the compensation time of a threshold voltage becomes longer due to the low mobility of a transistor.

Hereinafter, the detailed configuration and the driving method of the PWM pixel circuit 120 will be explained with reference to FIGS. 6A to 6C.

Figure 6A:
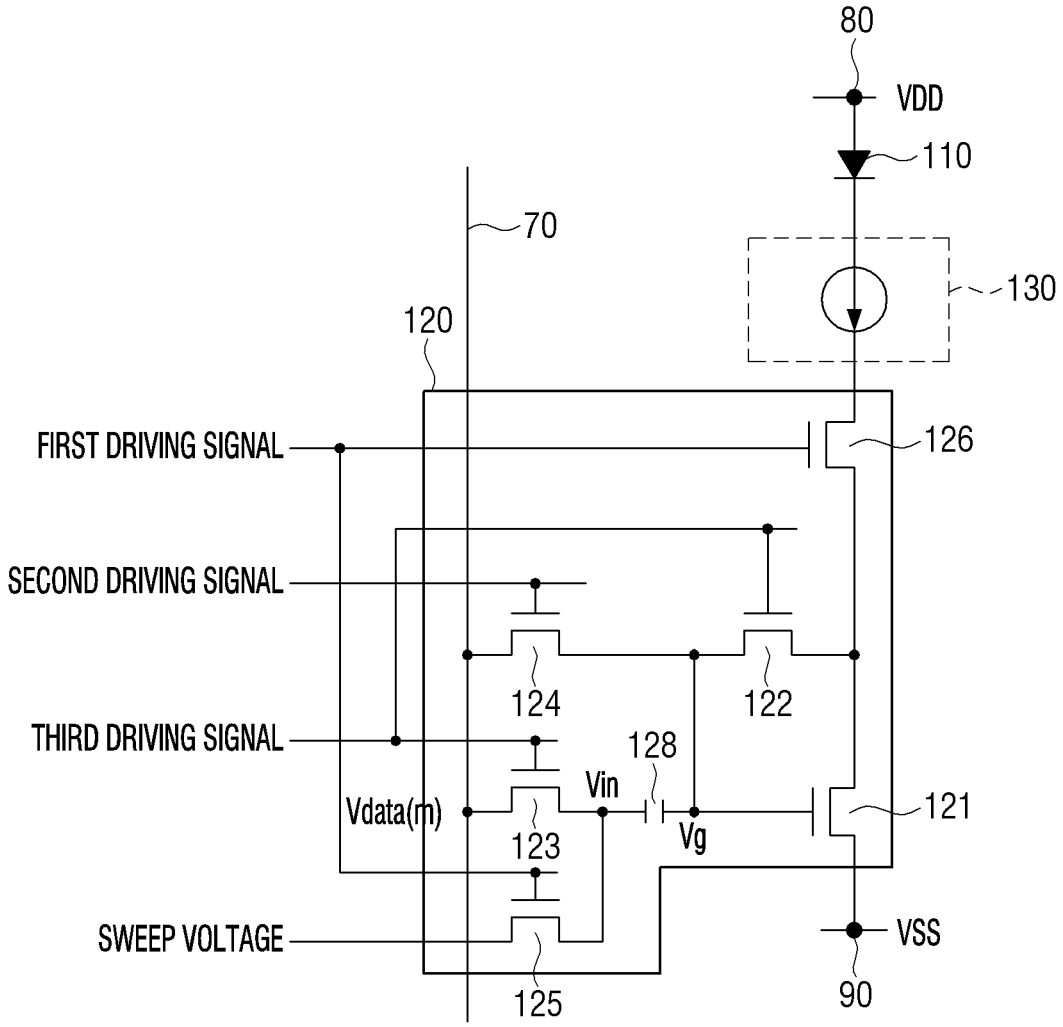
FIG. 6A is a circuit diagram illustrating a detailed configuration of a sub pixel according to embodiments.

FIG. 6A is a circuit diagram illustrating a detailed configuration of a sub pixel according to embodiments.

According to embodiments, one sub pixel included in the display panel 1000 may include a PWM pixel circuit 120, a light emitting element 110, and a constant current source 130, as illustrated in FIG. 6A.

The PWM pixel circuit 120 may control the light emitting duration of the light emitting element 110. The PWM pixel circuit 120 may include a control transistor 121 serially connected with the constant current source 130 and the light emitting element 110, and control the light emitting duration of the light emitting element 110 based on the turn-on/turn-off operation of the control transistor 121.

The control transistor 121 may be turned on/turned off based on a PWM data voltage and a sweep voltage applied to the PWM pixel circuit 120. In the control transistor 121, the gate terminal voltage Vg may be set (or programmed) to a first voltage based on a PWM data voltage and a sweep voltage during a data setting period, and the gate terminal voltage Vg may change according to the sweep voltage during a light emitting period and be turned on during a time period corresponding to the PWM data voltage.

When the control transistor 121 is turned on in a light emitting period as above, a driving current provided by the constant current source 130 may flow in the light emitting element 110 during the time period wherein the control transistor 121 is turned on. The light emitting element 110 emits light during the time period wherein a driving current flows in the light emitting element 110, i.e., during the driving time (or the pulse width) of a driving current, and thus the PWM pixel circuit 120 may control the light emitting duration of the light emitting element 110 based on a PWM data voltage and a sweep voltage.

For this, according to embodiments, the PWM pixel circuit 120 may be constituted as illustrated in FIG. 6A. FIG. 6A illustrates an embodiment wherein all the transistors included in the PWM pixel circuit 120 consist of N-channel metal oxide semiconductor field effect transistors (NMOS-FETs).

According to FIG. 6A, the PWM pixel circuit 120 may include a first transistor 122 connected between a drain terminal and a gate terminal of the control transistor 121. Also, the PWM pixel circuit 120 may include a first capacitor 128 of which one end is commonly connected with a drain terminal of the first transistor 122 and a gate terminal of the control transistor 121. In addition, the PWM pixel circuit 120 may include a second transistor 123 of which drain terminal is connected with a data line 70 to which a PWM data voltage is applied, and of which source terminal is connected with the other end of the first capacitor 128. Also, the PWM pixel circuit 120 may include a third transistor 124 of which source terminal is commonly connected with the drain terminal of the first transistor 122, the gate terminal of the control transistor 121, and the one end of the first capacitor 128, and of which drain terminal receives an initial voltage. In addition, the PWM pixel circuit 120 may include a fourth transistor 125 of which drain terminal receives a sweep voltage, and of which source terminal is commonly connected with the other end of the first capacitor 128 and a source terminal of the second transistor 123. Further, the PWM pixel circuit 120 may include a fifth transistor 126 of which drain terminal is connected with a cathode terminal of the light emitting element 110, and of which source terminal is commonly connected with the source terminal of the first transistor 122 and the drain terminal of the control transistor 121.

Here, the anode terminal of the light emitting element 110 may be connected with a driving voltage (VDD) terminal 80, and the source terminal of the control transistor 121 may be connected with the ground voltage (VSS) terminal 80.

Figure 6B:
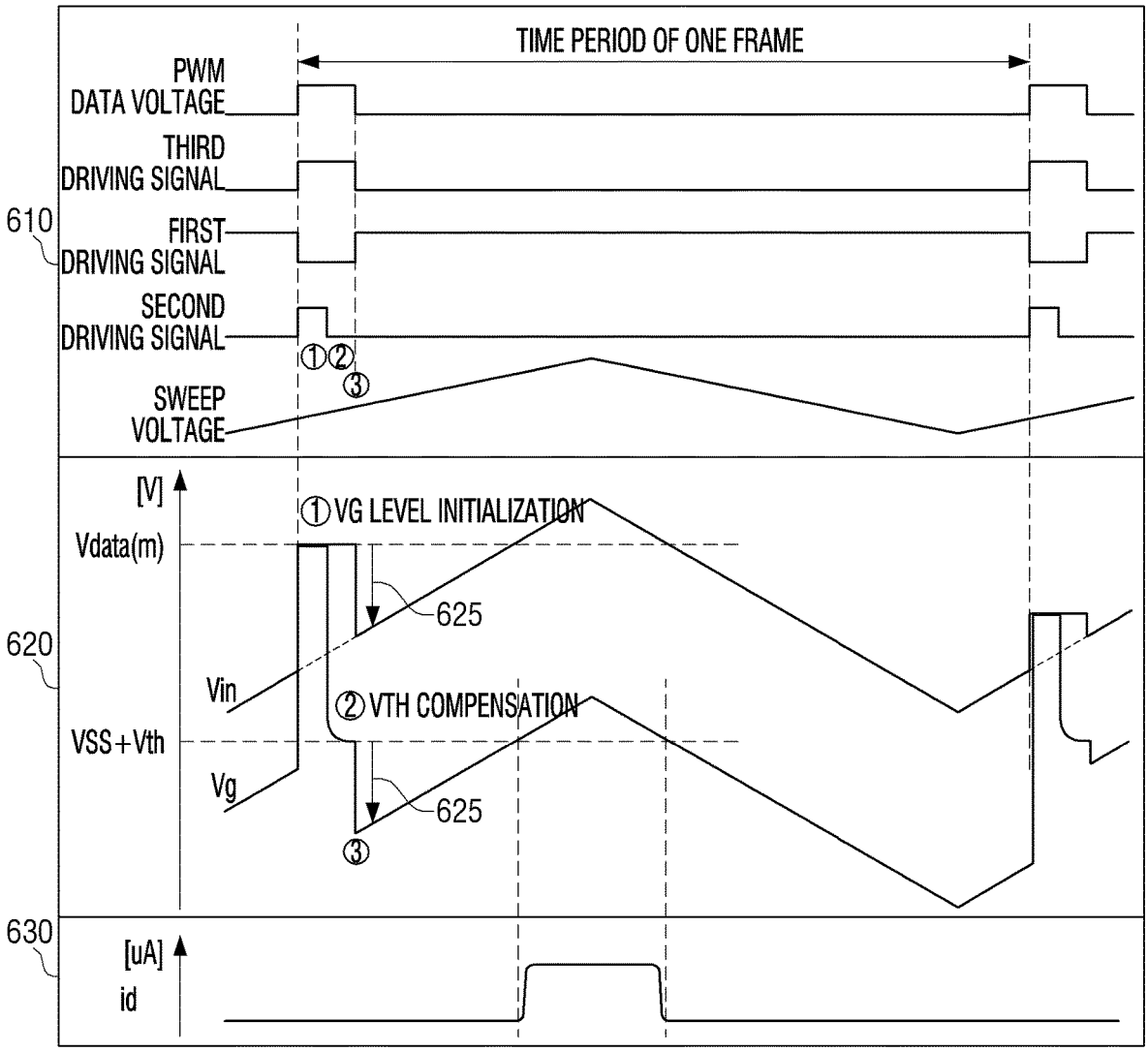
FIG. 6B is a diagram for illustrating a detailed operation of the sub pixel in FIG. 6A.

FIG. 6B is a diagram for illustrating a detailed operation of the sub pixel in FIG. 6A. In FIG. 6B, the reference numeral 610 illustrates the waveforms of a PWM data voltage, the first to third driving signals, and the sweep voltage applied to the PWM pixel circuit 120 in FIG. 6A during the time period of one frame.

Also, the reference numeral 620 illustrates the changes 625 of the gate terminal voltage (Vg, hereinafter, referred to as Vg) of the control transistor 121 and the voltage of the other end of the first capacitor 128 (Vin, hereinafter, referred to as Vin) while various signals as the reference numeral 610 are applied to the PWM pixel circuit 120, and the reference numeral 630 illustrates the driving time (or the pulse width) of a driving current id when the Vg changes as the reference numeral 620.

In the time period of one frame in FIG. 6B, the ① to ③ periods indicate data setting periods, and the other periods indicate light emitting periods.

The ① period is a period wherein the level of Vg is initialized. While the fourth transistor 125 is turned off according to the first driving signal, when the third transistor 124 is turned on according to the second driving signal, an initial voltage is applied to the gate terminal of the control transistor 121 through the turned-on third transistor 124. Here, the initial voltage may be a voltage that is higher than the threshold voltage of the control transistor 121.

Here, referring to FIG. 6A, it can be seen that the drain terminal of the third transistor 124 is connected with the data line 70 to which a PWM data voltage is applied. That is, FIG. 6A illustrates an embodiment wherein a PWM data voltage is used as an initial voltage.

Accordingly, when the third transistor 124 is turned on according to the second driving signal in the ① period, a PWM data voltage Vdata(m) is applied to the gate terminal of the control transistor 121 as an initial voltage through the turned on third transistor 124, and accordingly, the Vg is raised to the PWM data voltage Vdata(m).

The ② period is a period for compensating the threshold voltage Vth of the control transistor 121. In the ② period, the third transistor 124 is turned off according to the second driving signal, and thus the initial voltage is not applied to the gate terminal of the control transistor 121 anymore. Here, the first and second transistors 122, 123 are in a turned-on state according to the third driving signal, and thus the Vin maintains the PWM data voltage Vdata(m), and the Vg is reduced from the initial voltage to a voltage VSS+Vth that is a sum of the ground voltage VSS and the Vth.

When the ② period starts, an initial voltage that is bigger than the Vth is being applied to the gate terminal of the control transistor 121, and thus the control transistor 121 is in a turned-on state. Also, the first transistor 122 is in a turned-on state according to the third driving signal, and thus a current gets to flow through the first transistor 122 and the control transistor 121. As a current flows, the Vg gets to be reduced from the initial voltage, and when the Vg is reduced to VSS+Vth, the control transistor 121 is turned off, and thus the flow of the current gets to stop.

As described above, the Vg becomes VSS+Vth during the ② period, and accordingly, the threshold voltage Vth of the control transistor 121 gets to be compensated.

The ③ period indicates a period wherein a PWM data voltage is set (or programmed) to the gate terminal of the control transistor. In the ③ period, the first and second transistors 122, 123 are turned off according to the third driving signal, and the fourth transistor 125 is turned on according to the first driving signal.

Accordingly, the Vin is reduced from the PWM data voltage Vdata(m) to the sweep voltage Vsweep(t) at the time point when the first and second transistors 122, 123 are turned off. That is, the Vin is reduced as much as Vdata (m)−Vsweep(t)(625).

Such a change of the Vin is coupled to the gate terminal of the control transistor 121 through the first capacitor 128. Thus, theoretically, the Vg is also reduced from VSS+Vth as much as Vdata(m)−Vsweep(t)(6). Because of the parasitic capacitance component of the control transistor, the Vg will actually be reduced a little smaller than Vdata(m)−Vsweep (t)(625).

As described above, in the ③ period, the Vg is reduced from VSS+Vth as much as Vdata(m)−Vsweep(t)(625), and accordingly, a PWM data voltage is set to the gate terminal of the control transistor 121.

In the light emitting period that proceeds afterwards, the fourth transistor 125 maintains a turned-on state according to the first driving signal. Accordingly, the Vin gets to change according to the change of the sweep voltage, and such a change is coupled through the first capacitor 128 and the Vg also changes according to the change of the sweep voltage. When the light emitting period starts, the Vg gets to change from a voltage that is reduced from VSS+Vth as much as Vdata(m)−Vsweep(t) according to the change of the sweep voltage.

The control transistor 121 is turned on in a period wherein the Vg that changes according to the change of the sweep voltage becomes higher than VSS+Vth, and while the control transistor 121 is turned on, a driving current id flows in the light emitting element 110, and the light emitting element 110 gets to emit light. In a period wherein the Vg is lower than VSS+Vth among the light emitting periods, the control transistor 121 is turned off, and thus the driving current id obviously does not flow.

In the above operation, the fifth transistor 126 performs the role of electronically separating the light emitting element 110 and the PWM pixel circuit 120 during a data setting period. The fifth transistor 126 is in a turned-off state in a data setting period according to the first driving signal, and accordingly, in a data setting period, even if the control transistor 121 is turned on, a driving current provided by the constant current source 130 does not get to flow to the light emitting element 110.

Figure 6C:
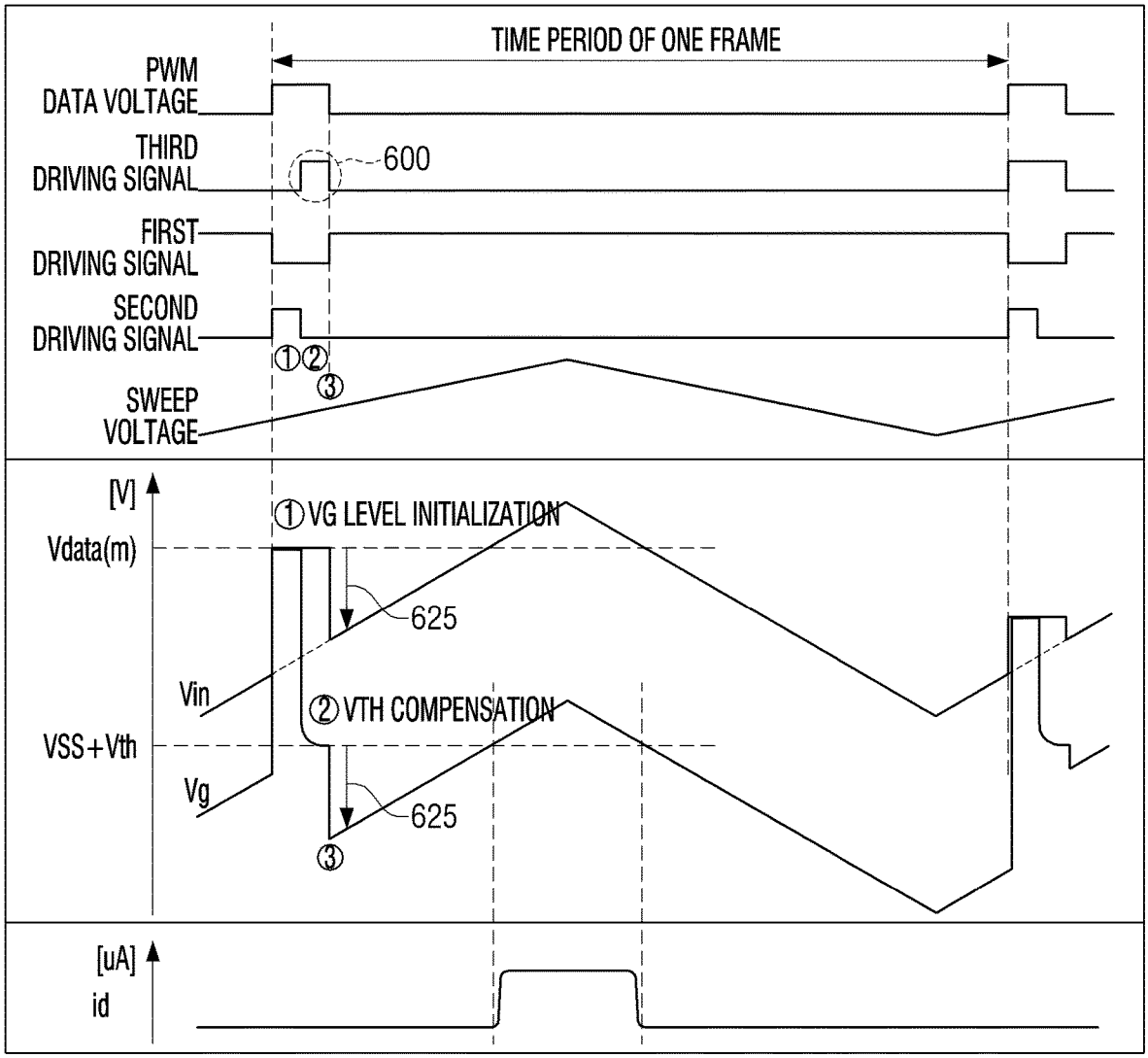
FIG. 6C is a diagram for illustrating a different driving method of the sub pixel in FIG. 6A.

FIG. 6C is a diagram for illustrating a different driving method of the sub pixel in FIG. 6A. FIG. 6C is identical to FIG. 6B, but as illustrated in the reference numeral 600, the third driving signal is driven differently from FIG. 6B.

That is, according to embodiments, the third driving signal may be driven such that, while the third transistor 124 is turned on according to the second driving signal in the ① period, the first and second transistors 122, 123 are turned off, and when the third transistor 124 is turned off (or at the same time that the third transistor 124 is turned off) according to the second driving signal in the ② period, the first and second transistors 122, 123 are turned on.

As described above, even if the third driving signal is driven, the PWM pixel circuit 120 may operate in the same way as described with reference to FIG. 6B above.

Figure 7:
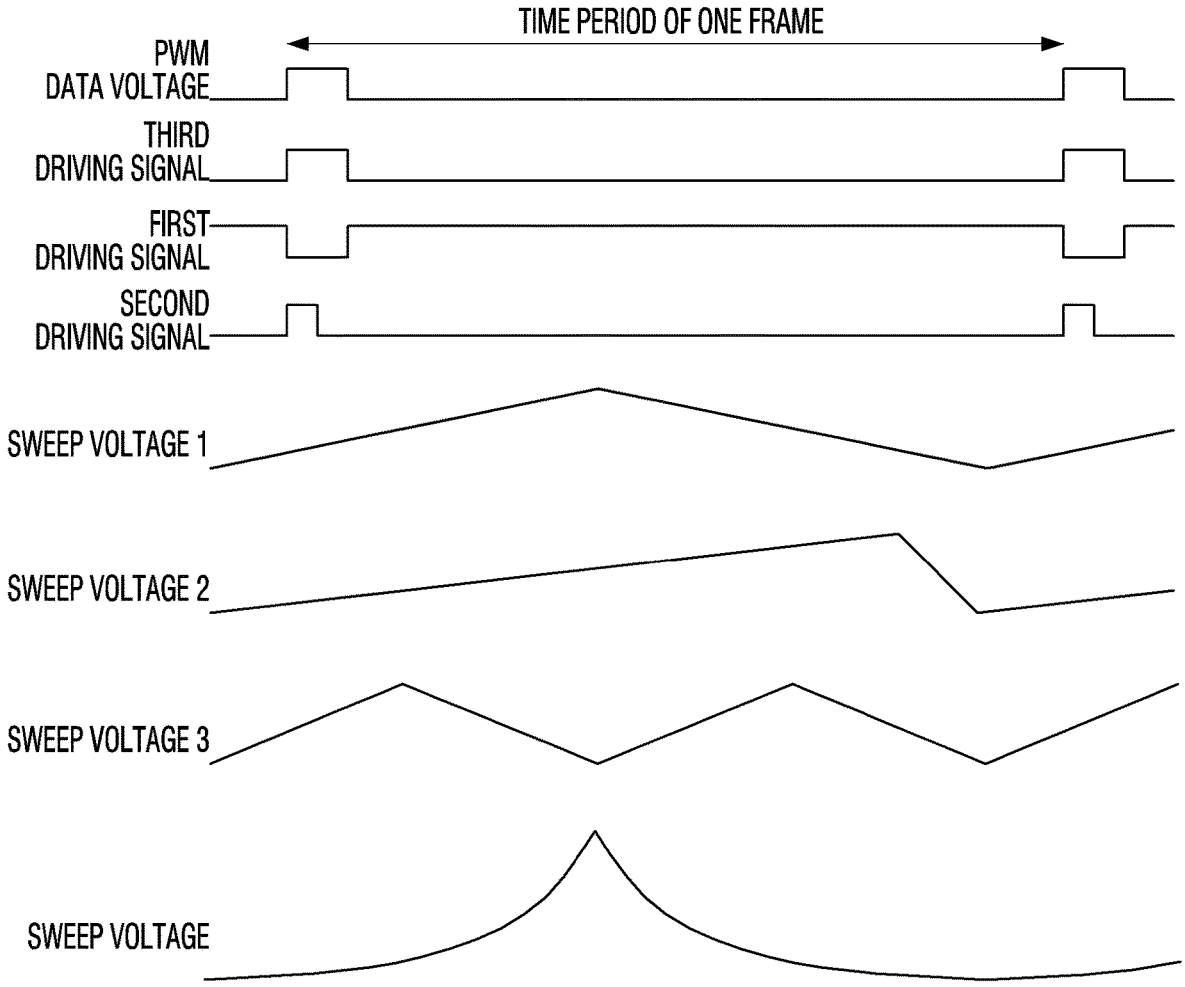
FIG. 7 is a diagram illustrating types of sweep voltages according embodiments.

FIG. 7 is a diagram illustrating types of sweep voltages according embodiments. As described above, a sweep voltage may be a voltage wherein the time period of one frame is one period, and which continuously changes during one period.

Any voltage that satisfies the condition as above may be used as a sweep voltage. For example, a sweep voltage may have a form that continuously changes linearly during the time period of one frame, as the sweep voltages 1 to 3 illustrated in FIG. 7, or it may have a form that continuously changes non-linearly as the sweep voltage 4.

As described above, in FIG. 6A, an embodiment wherein a PWM data voltage is used as an initial voltage was explained, but embodiments are not limited thereto. That is, according to another embodiment of the disclosure, to the PWM pixel circuit 120, a separate initial voltage, but not a PWM data voltage, may be applied according to a driving order.

Figure 8:
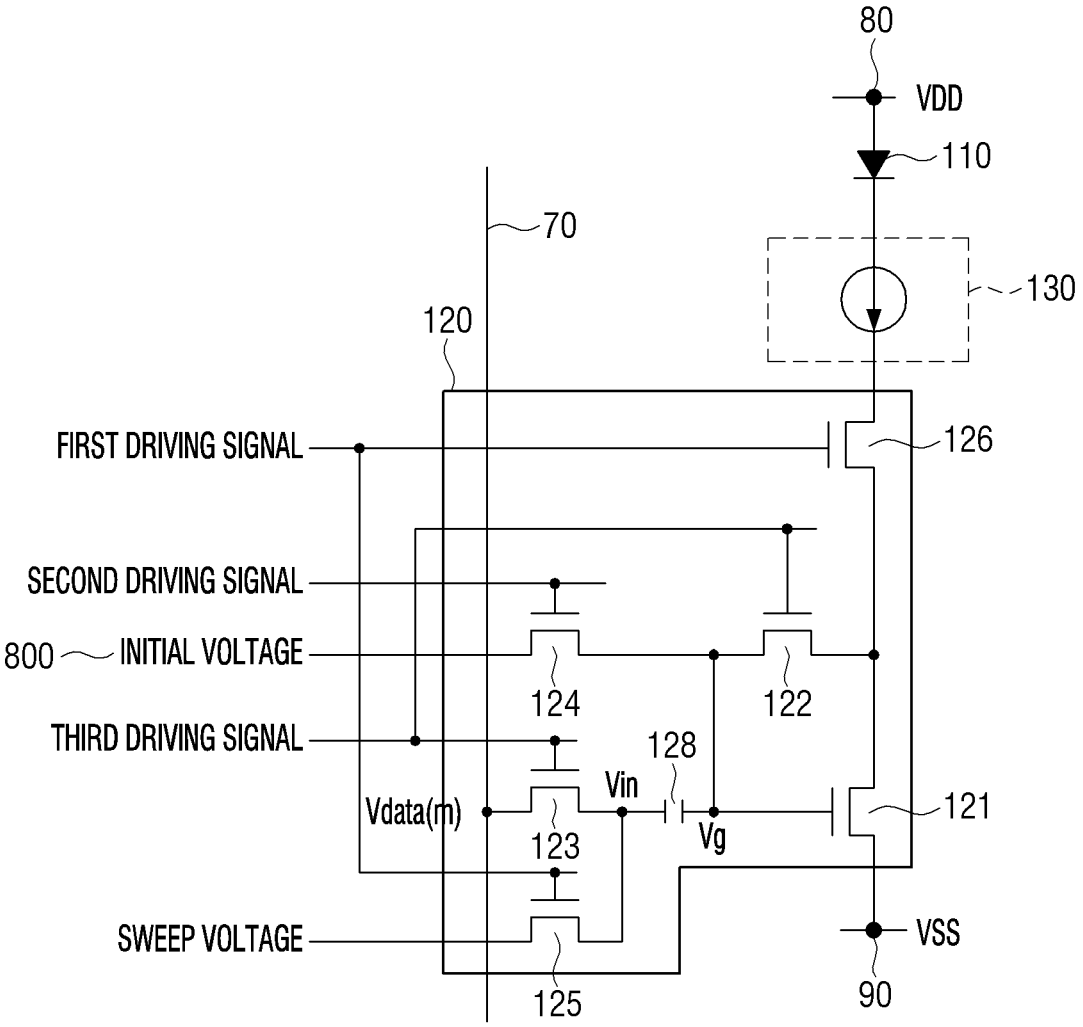
FIG. 8 is a circuit diagram illustrating a detailed configuration of a sub pixel wherein a separate initial voltage is applied to a PWM pixel circuit, according to embodiments.

FIG. 8 is a circuit diagram illustrating a detailed configuration of a sub pixel wherein a separate initial voltage is applied to the PWM pixel circuit 120, according to embodiments. Referring to FIG. 8, it can be seen that the configuration of the sub pixels is identical to FIG. 6A, but a separate initial voltage is applied to the PWM pixel circuit 120 as the reference numeral 800.

In this case, in the ① period of FIG. 6B, the Vin and the Vg will not rise to a PWM data voltage Vdata(m), but to an initial voltage (e.g., Vini) separately applied. Excluding this, the other operations are as described with reference to FIG. 6B above.

Figure 9A:
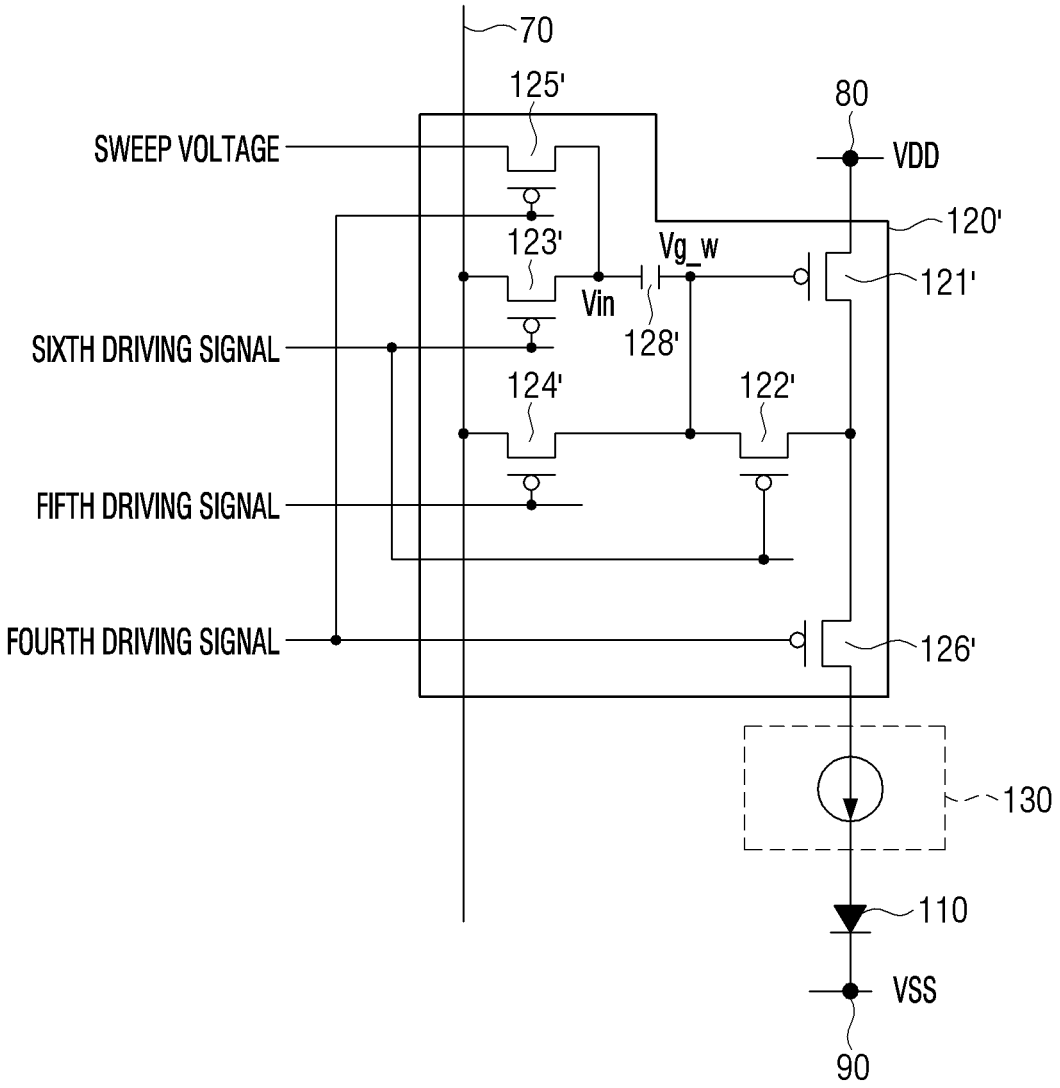
FIG. 9A is a circuit diagram illustrating a detailed configuration of a sub pixel wherein all transistors included in a PWM pixel circuit consist of PMOSFETs, according to embodiments.

FIG. 9A is a circuit diagram illustrating a detailed configuration of a sub pixel wherein all transistors included in a PWM pixel circuit 120' consist of P-channel metal oxide semiconductor field effect transistors (PMOSFETs), according to embodiments.

According to FIG. 9A, the PWM pixel circuit 120' may include a sixth transistor 122' connected between a drain terminal and a gate terminal of the control transistor 121'. Also, the PWM pixel circuit 120' may include a second capacitor 128' of which one end is commonly connected with a source terminal of the sixth transistor 122' and a gate terminal of the control transistor 121'. In addition, the PWM pixel circuit 120' may include a seventh transistor 123' of which source terminal is connected with a data line 70 to which a PWM data voltage is applied, and of which drain terminal is connected with the other end of the second capacitor 128'. Also, the PWM pixel circuit 120' may include an eighth transistor 124' of which drain terminal is commonly connected with the source terminal of the sixth transistor 122', the gate terminal of the control transistor 121', and the one end of the second capacitor 128', and of which source terminal receives an initial voltage. In addition, the PWM pixel circuit 120' may include a ninth transistor 125' of which source terminal receives a sweep voltage, and of which drain terminal is commonly connected with the other end of the second capacitor 128' and the drain terminal of the seventh transistor 123'. Further, the PWM pixel circuit 120' may include a tenth transistor 126' of which drain terminal is connected with an anode terminal of the light emitting element 110, and of which source terminal is commonly connected with the drain terminal of the sixth transistor 122' and the drain terminal of the control transistor 121'.

Here, the cathode terminal of the light emitting element 110 may be connected with the ground voltage (VSS) terminal 90, and the source terminal of the control transistor 121' may be connected with the driving voltage (VDD) terminal 80.

In the case of FIG. 9A, it can be seen that the source terminal of the eighth transistor 124' to which an initial voltage is applied is connected with the data line 70 to which a PWM data voltage is applied. That is, FIG. 9A illustrates an embodiment wherein, when a transistor included in the PWM pixel circuit 120' is a PMOSFET, a PWM data voltage is used as an initial voltage.

However, as described above, a separate voltage that is different from a PWM data voltage may be used as an initial voltage.

Figure 9B:
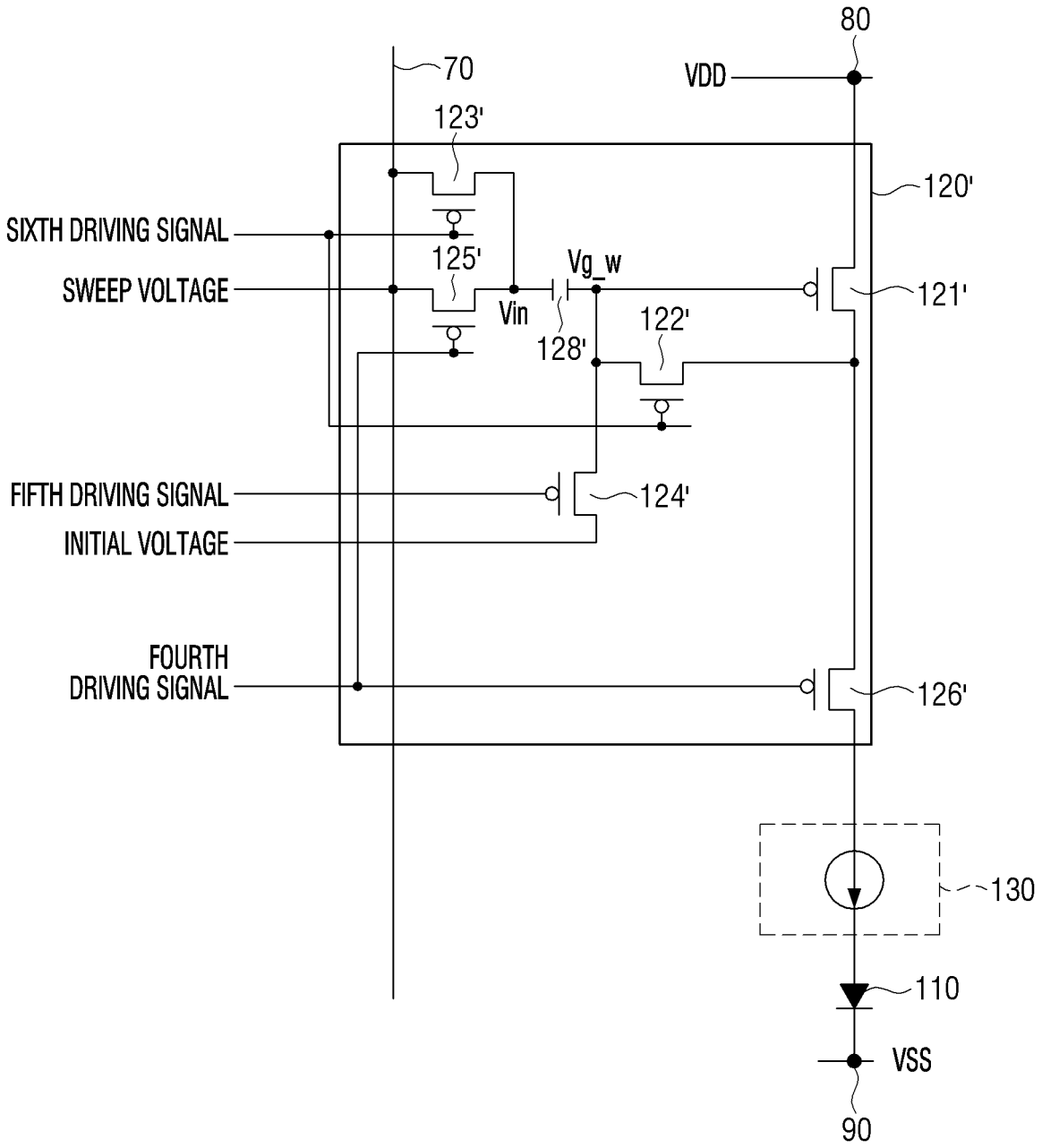
FIG. 9B is a circuit diagram illustrating a detailed configuration of a sub pixel wherein an initial voltage is separately applied in the PWM pixel circuit in FIG. 9A.

FIG. 9B a circuit diagram illustrating a detailed configuration of a sub pixel wherein an initial voltage is separately applied in the PWM pixel circuit 120' in FIG. 9A. Referring to FIG. 9B, it can be seen that the configuration of the PWM pixel circuit 120' is identical to that of the PWM pixel circuit 120' in FIG. 9A, but a separate initial voltage is applied through the source terminal of the eighth transistor 124' as the reference numeral 900.

Figure 9C:
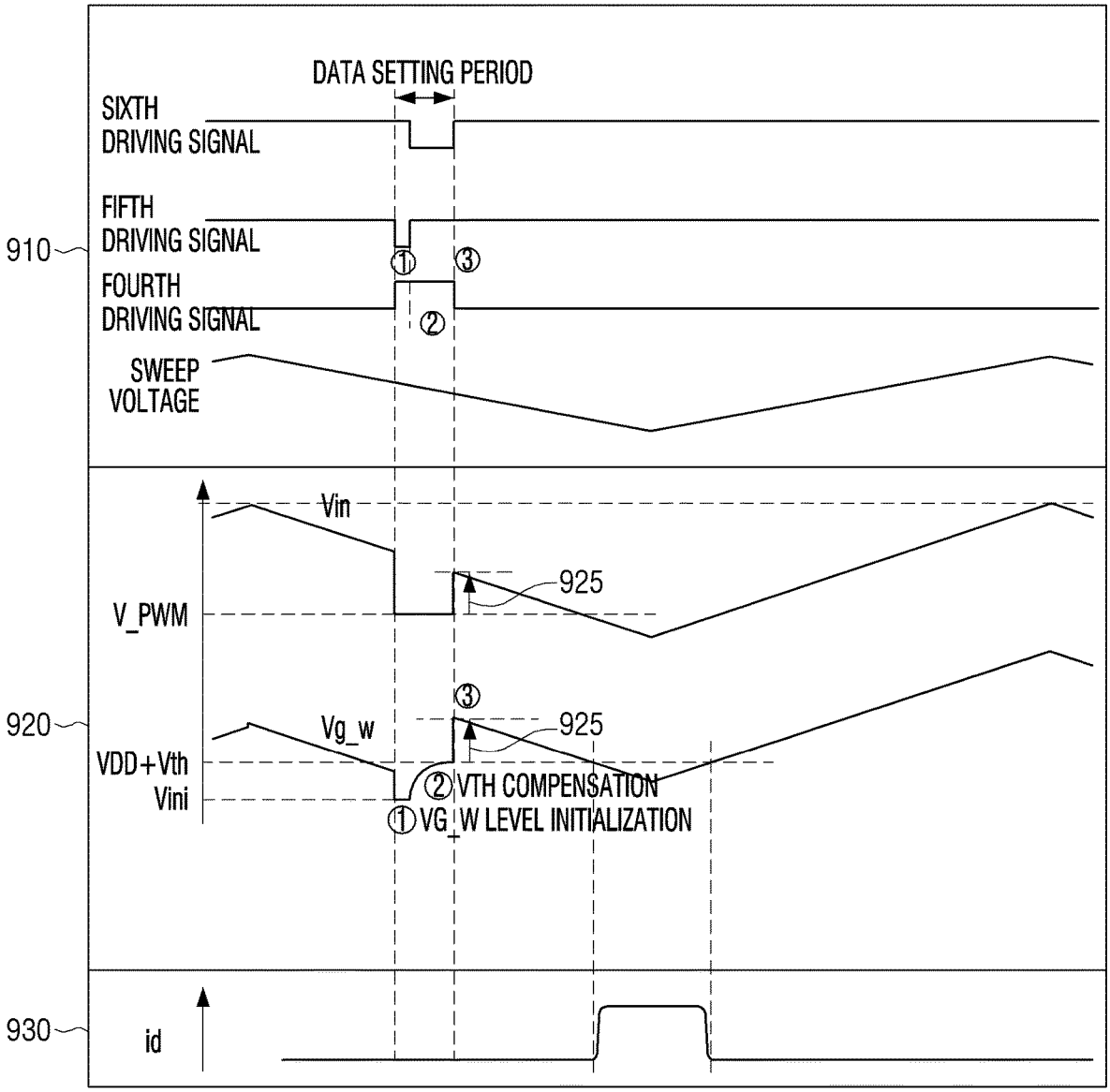
FIG. 9C is a diagram for illustrating a detailed operation of the sub pixel in FIGS. 9A and 9B.

FIG. 9C is a diagram for illustrating a detailed operation of the sub pixel in FIGS. 9A and 9B. In FIG. 9C, the reference numeral 910 illustrates the waveforms of the first to third driving signals and the sweep voltage applied to the PWM pixel circuit 120' during the time period of one frame.

Also, the reference numeral 920 illustrates the changes 925 of the gate terminal voltage (Vg_w, hereinafter, referred to as Vg_w) of the control transistor 121' and the voltage of the other end of the second capacitor 128' (Vin, hereinafter, referred to as Vin) while various signals as the reference numeral 910 are applied to the PWM pixel circuit 120', and the reference numeral 930 illustrates the driving time (or the pulse width) of a driving current id when the Vg_w changes as the reference numeral 920.

The ① to ③ periods in FIG. 9C indicate data setting periods, and the other periods indicate light emitting periods.

The ① period is a period wherein the level of Vg_w is initialized. While the ninth transistor 125' is turned off according to the fourth driving signal, when the eighth transistor 124' is turned on according to the fifth driving signal, an initial voltage *Vini* is applied to the gate terminal of the control transistor 121' through the turned-on eighth transistor 124'. Accordingly, Vg_w is initialized as Vini. Here, as the initial voltage Vini, a PWM data voltage or a voltage for a separate initial voltage may be used, as described above.

The ② period is a period for compensating the threshold voltage Vth of the control transistor 121'. In the ② period, the eighth transistor 124' is turned off according to the fifth driving signal, and thus the initial voltage is not applied to the gate terminal of the control transistor 121' anymore. Here, the sixth and seventh transistors 122', 123' are turned on according to the sixth driving signal, and thus a current flows through the control transistor 121' and the sixth transistor 122' during the ② period, and accordingly, the Vg_w rises from the initial voltage to a voltage that is a value of subtracting the Vth from the driving voltage VDD (VDD-Vth). As described above, during the ② period, the Vg_w becomes VDD-Vth, and thus the threshold voltage Vth of the control transistor 121' is compensated.

The ③ period indicates a period wherein a PWM data voltage is set (or programmed) to the gate terminal of the control transistor. In the ③ period, the sixth and seventh transistors 122', 123' are turned off according to the sixth driving signal, and the ninth transistor 125' is turned on according to the fourth driving signal.

Accordingly, the Vin rises from the PWM data voltage V_PWM to the sweep voltage Vsweep(t) at the time point when the sixth and seventh transistors 122', 123' are turned off That is, the Vin rises as much as Vsweep(t)−V_PWM (925).

Such a change of the Vin is coupled to the gate terminal of the control transistor 121' through the second capacitor 128'. Thus, theoretically, the Vg_w also rises from VDD−Vth as much as Vsweep(t)−V_PWM (925). Because of the parasitic capacitance component of the control transistor, the Vg will actually rise a little smaller than Vsweep(t)−V_PWM (925). As described above, in the ③ period, the Vg_w rises from VDD-Vth as much as Vsweep(t)−V_PWM (925), and accordingly, a PWM data voltage is set to the gate terminal of the control transistor 121'.

In the light emitting period that proceeds afterwards, the ninth transistor 125' maintains a turned-on state according to the fourth driving signal. Accordingly, the Vin gets to change according to the change of the sweep voltage, and such a change is coupled through the second capacitor 128' and the Vg_w also changes according to the change of the sweep voltage. When the light emitting period starts, the Vg_w gets to change from a voltage that rose from VDD−Vth as much as Vsweep(t)−V_PWM (925) according to the change of the sweep voltage.

The control transistor 121' is turned on in a period wherein the Vg_w that changes according to the sweep voltage becomes lower than VDD−Vth, and while the control transistor 121' is turned on, a driving current id flows in the light emitting element 110, and the light emitting element 110 gets to emit light. In a period wherein the Vg_w is higher than VDD−Vth among the light emitting periods, the control transistor 121' is turned off, and thus the driving current id obviously does not flow.

In the above operation, the tenth transistor 126' performs the role of electronically separating the light emitting element 110 and the PWM pixel circuit 120 during a data setting period. The tenth transistor 126' is in a turned-off state in a data setting period according to the fourth driving signal, and accordingly, in a data setting period, even if the control transistor 121' is turned on, a driving current provided by the constant current source 130 does not get to flow to the light emitting element 110.

Hereinafter, other various modified embodiments of the disclosure will be explained with reference to FIGS. 10 to 16B.

Figure 10:
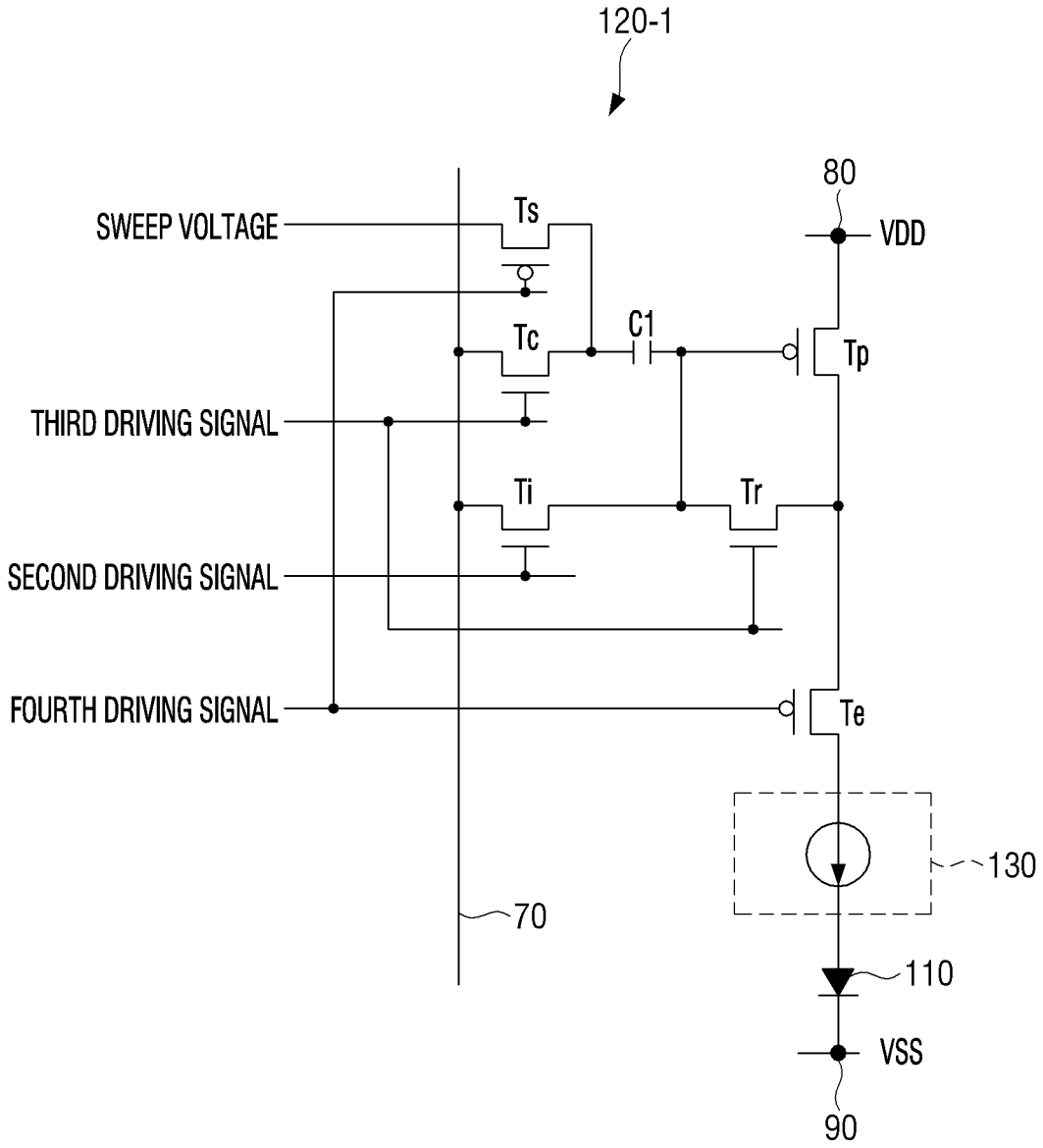
FIG. 10 is a circuit diagram illustrating a detailed configuration of a sub pixel wherein an NMOSFET and a PMOSFET are interchangeably used in a PWM pixel circuit, according to embodiments.

FIG. 10 a circuit diagram illustrating a detailed configuration of a sub pixel wherein an NMOSFET and a PMOSFET are interchangeably used in a PWM pixel circuit 120-1, according to embodiments. In FIG. 10, it can be seen that a control transistor Tp, a transistor Ts to which a sweep voltage is applied, and a transistor Te that electronically connects or separates a light emitting element and a PWM pixel circuit 120-1 are implemented as PMOSFETs, and the other transistors Tc, Ti, Tr are implemented as NMOSFETs.

Accordingly, by applying the second and third driving signals explained in FIG. 6B or FIG. 6C as driving signals for driving an NMOSFET to the PWM pixel circuit 120-1, and by applying the fourth driving signal explained in FIG. 9C as a driving signal for driving a PMOSFET, the PWM pixel circuit 120-1 may operate as the aforementioned PWM pixel circuits 120, 120'.

Figure 11:
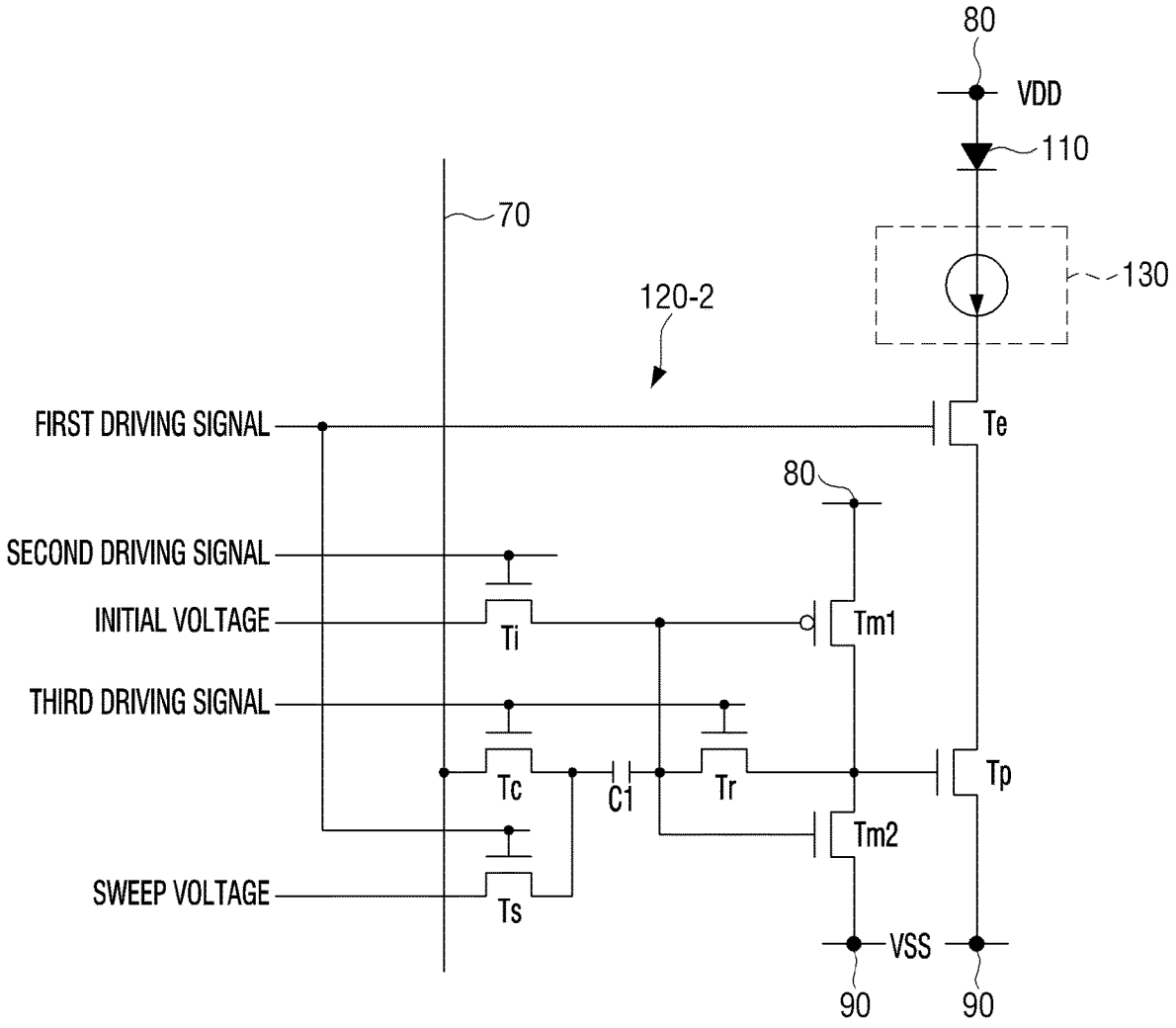
FIG. 11 is a circuit diagram illustrating a detailed configuration of a sub pixel wherein a PWM pixel circuit is constituted using a CMOSFET, according to embodiments.

FIG. 11 is a circuit diagram illustrating a detailed configuration of a sub pixel wherein a PWM pixel circuit 120-2 is constituted using a complementary metal oxide semiconductor field effect transistor (CMOSFET), according to embodiments. The CMOSFET includes transistors Tm1 and Tm2. In this case, if the initial voltage, the sweep voltage, and the first to third driving signals explained in FIG. 6B or FIG. 6C are applied as illustrated in FIG. 11, the PWM pixel circuit 120-2 may operate as the aforementioned pixel circuit 120. A capacitor C1 is interposed between the transistors Tc and Tr, and connected in series to the transistors Tc and Tr.

According to embodiments, the sub pixels included in the display panel 1000 may be driven directly by using a driving voltage (VDD) without the constant current source 130.

Figure 12:
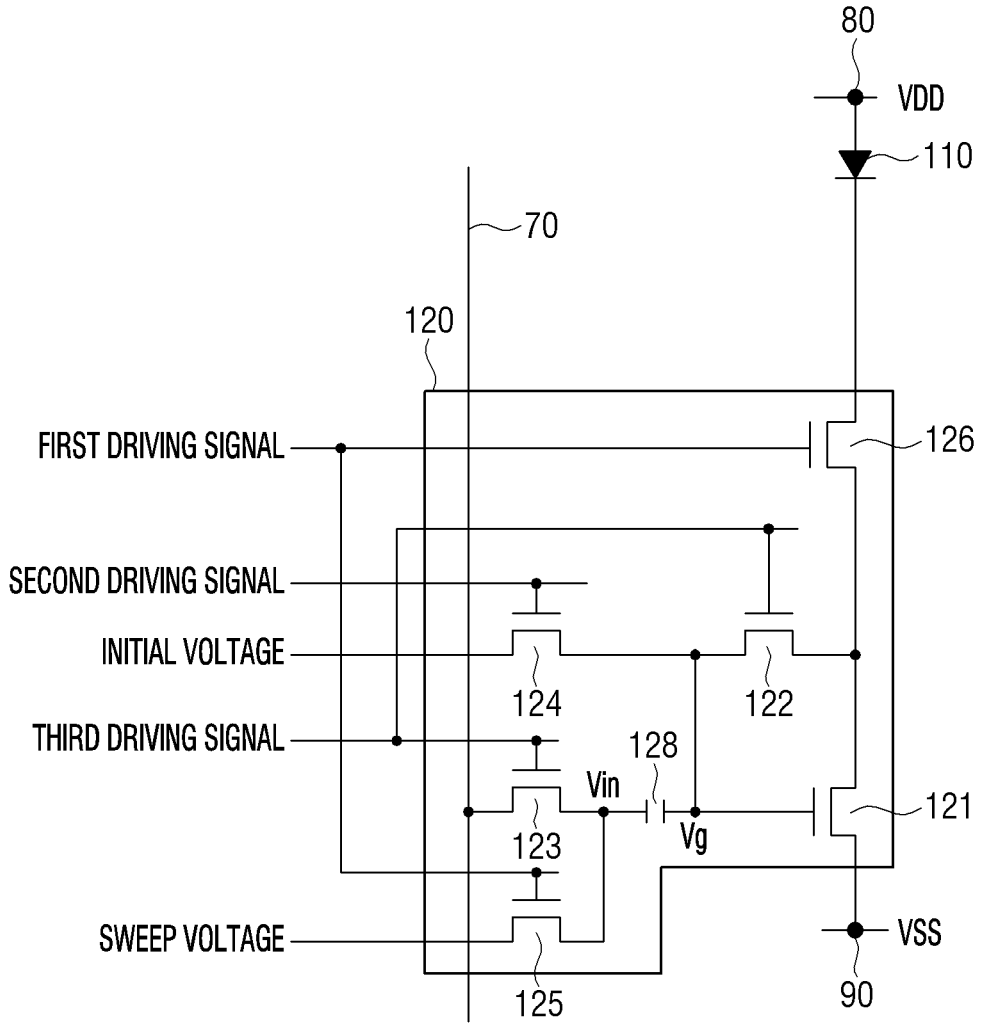
FIG. 12 is a circuit diagram illustrating a detailed configuration of a sub pixel constituted without a constant current source, according to embodiments.

FIG. 12 is a circuit diagram illustrating a detailed configuration of a sub pixel constituted without the constant current source 130, according to embodiments.

Referring to FIG. 12, the sub pixel has the same configuration as that of the sub pixel illustrated in FIG. 8, except that there is no constant current source 130. However, embodiments are not limited thereto, and it is obvious that in the aforementioned configuration of the sub pixel in FIGS. 6A, 9A, 9B, 10, and 11, the sub pixel may be driven by directly using a driving voltage VDD without the constant current source 130.

Figure 13:
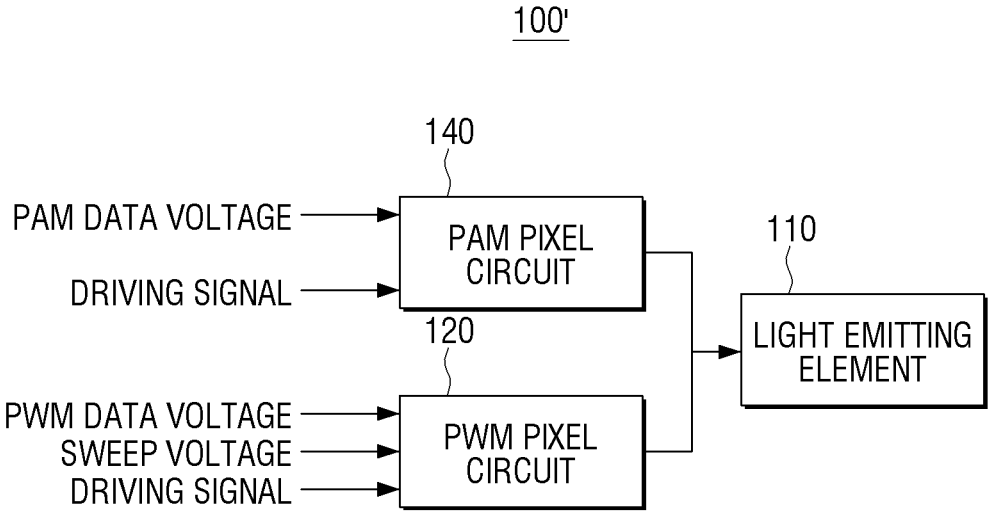
FIG. 13 is a schematic block diagram of a sub pixel further including a PAM pixel circuit, according to embodiments.

FIG. 13 is a schematic block diagram of a sub pixel 100' further including a PAM pixel circuit 140, according to embodiments. Referring to FIG. 13, the sub pixel 100' further includes the PAM pixel circuit 140 in addition to the sub pixel 100 in FIG. 3.

The PAM pixel circuit 140 controls the amplitude of a driving current provided to the light emitting element 110 based on the applied PAM data voltage. The PAM pixel circuit 140 may receive, for example, a PAM data voltage from a data driver, and provide a driving current having an amplitude corresponding to the applied PAM data voltage to the light emitting element 110.

Here, the PWM pixel circuit 120 may control the pulse width of the driving current by controlling the driving time of the driving current (i.e., a driving current having an amplitude corresponding to the PAM data voltage) that the PAM pixel circuit 140 provides to the light emitting element 110 based on the PWM data voltage as described above.

Figure 14A:
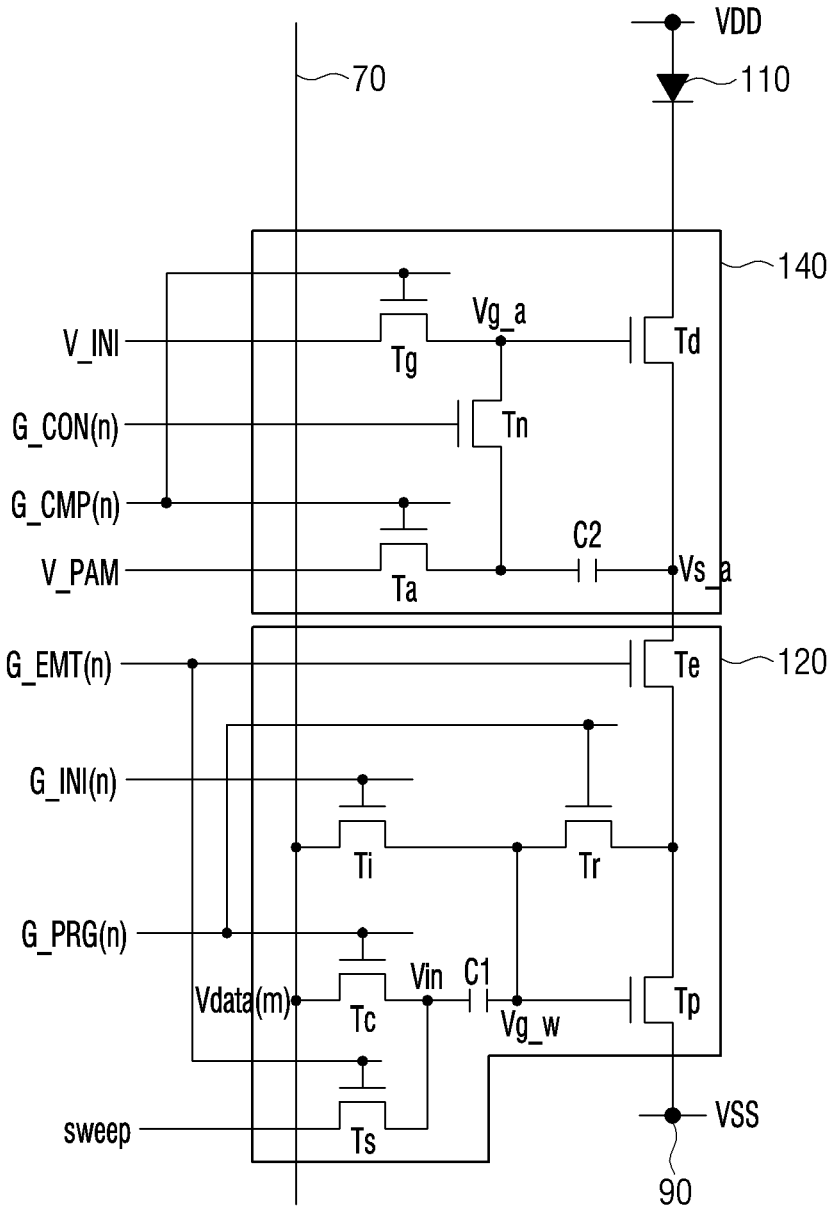
FIG. 14A is a circuit diagram illustrating an example of a configuration of a sub pixel further including a PAM pixel circuit in addition to the PWM pixel circuit in FIG. 6A, according to embodiments.

FIG. 14A is a circuit diagram illustrating an example of a configuration of a sub pixel further including the PAM pixel circuit 140 in addition to the PWM pixel circuit 120 in FIG. 6A, according to embodiments. Here, the sub pixel in FIG. 14A may operate as illustrated in FIG. 14B or FIG. 14C.

Figure 14B:
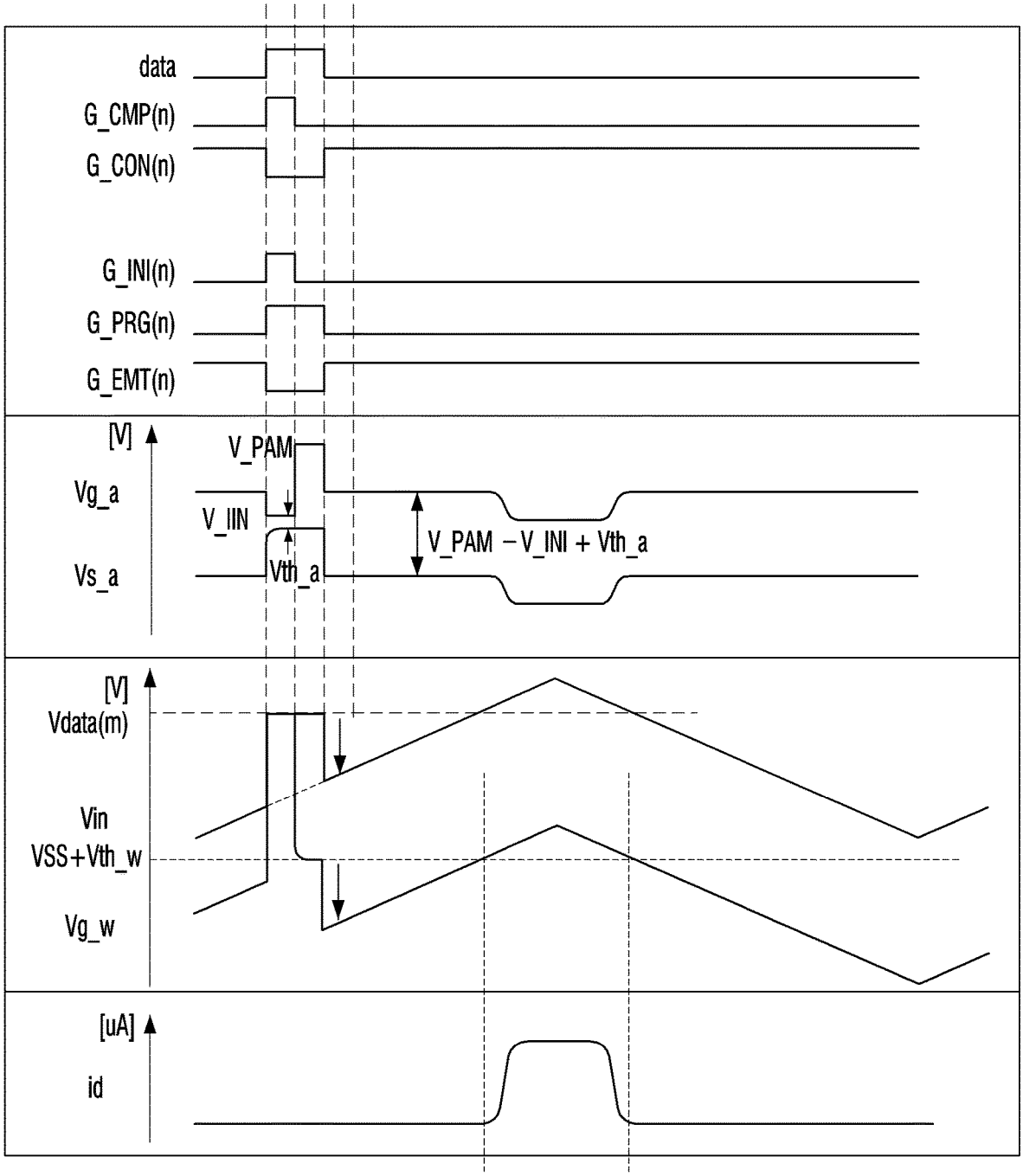
FIG. 14B is a diagram illustrating a first method of driving the sub pixel in FIG. 14A.

FIG. 14B is a diagram illustrating a first method of driving the sub pixel in FIG. 14A. FIG. 14C is a diagram illustrating a second method of driving the sub pixel in FIG. 14A.

FIG. 14B illustrates an example of driving wherein, while the PWM pixel circuit 120 operates in a data setting period, PAM data setting of the PAM pixel circuit 140 and compensation of the threshold voltage of the driving transistor Td are performed together. FIG. 14C illustrates an example of driving wherein, while data setting periods in the PWM pixel circuit 120 proceed for each row line, but in the case of the PAM pixel circuit 140, PAM data setting and compensation of the threshold voltage of the driving transistor Td are performed integrally at the same time in the entire sub pixels included in the display panel 1000.

Figure 14C:
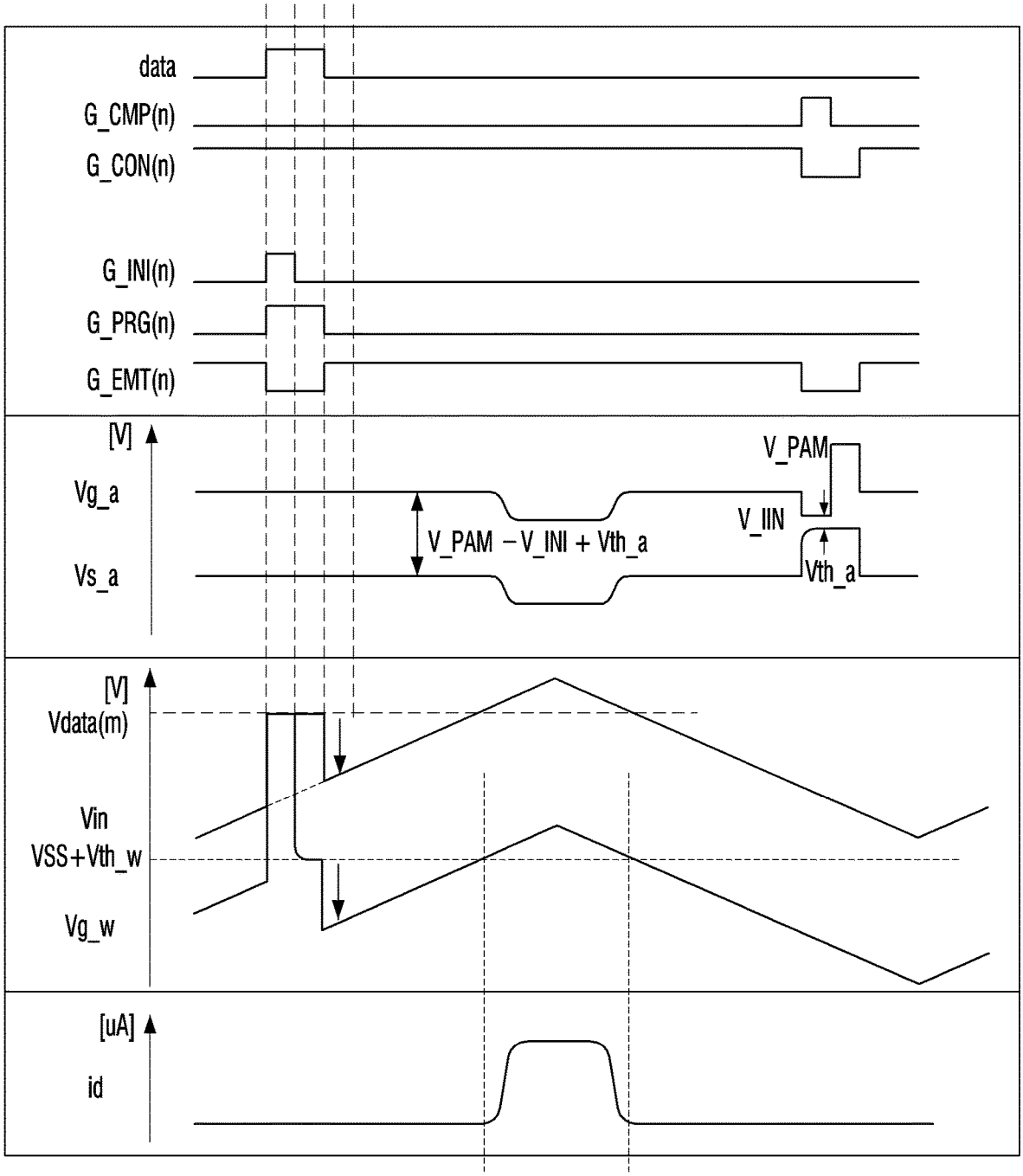
FIG. 14C is a diagram illustrating a second method of driving the sub pixel in FIG. 14A.

In FIGS. 14B and 14C, the operations of the PWM pixel circuit 120 are as described above through FIG. 6B, and the detailed operation of the PAM pixel circuit 140 is outside the range of the gist of the disclosure, and thus more detailed explanation will be omitted.

Figure 15A:
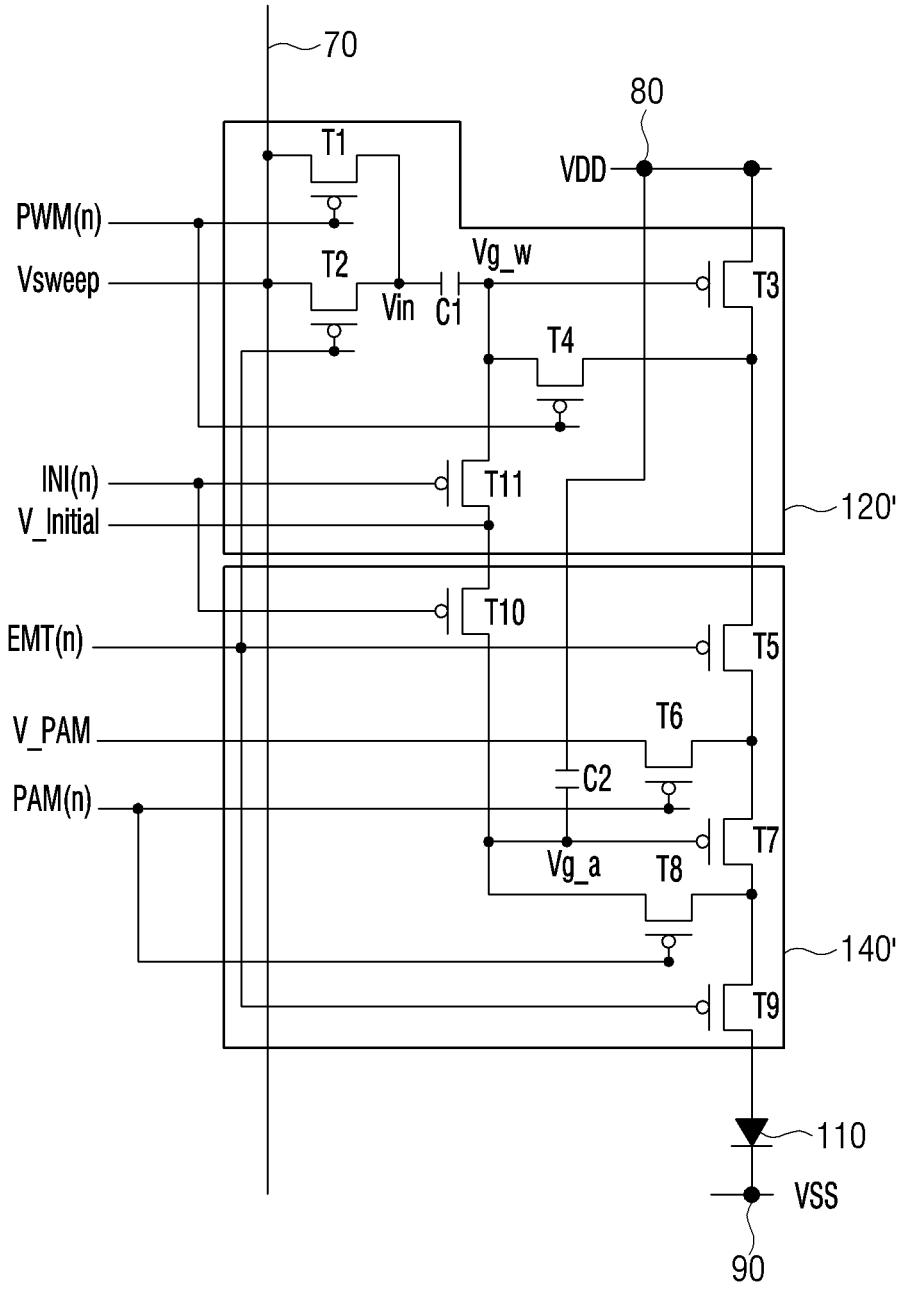
FIG. 15A is a circuit diagram illustrating a detailed configuration of a sub pixel wherein both of a PAM pixel circuit and a PWM pixel circuit included in the sub pixel of a display panel are implemented as PMOSFETs, according to embodiments.
Figure 15B:
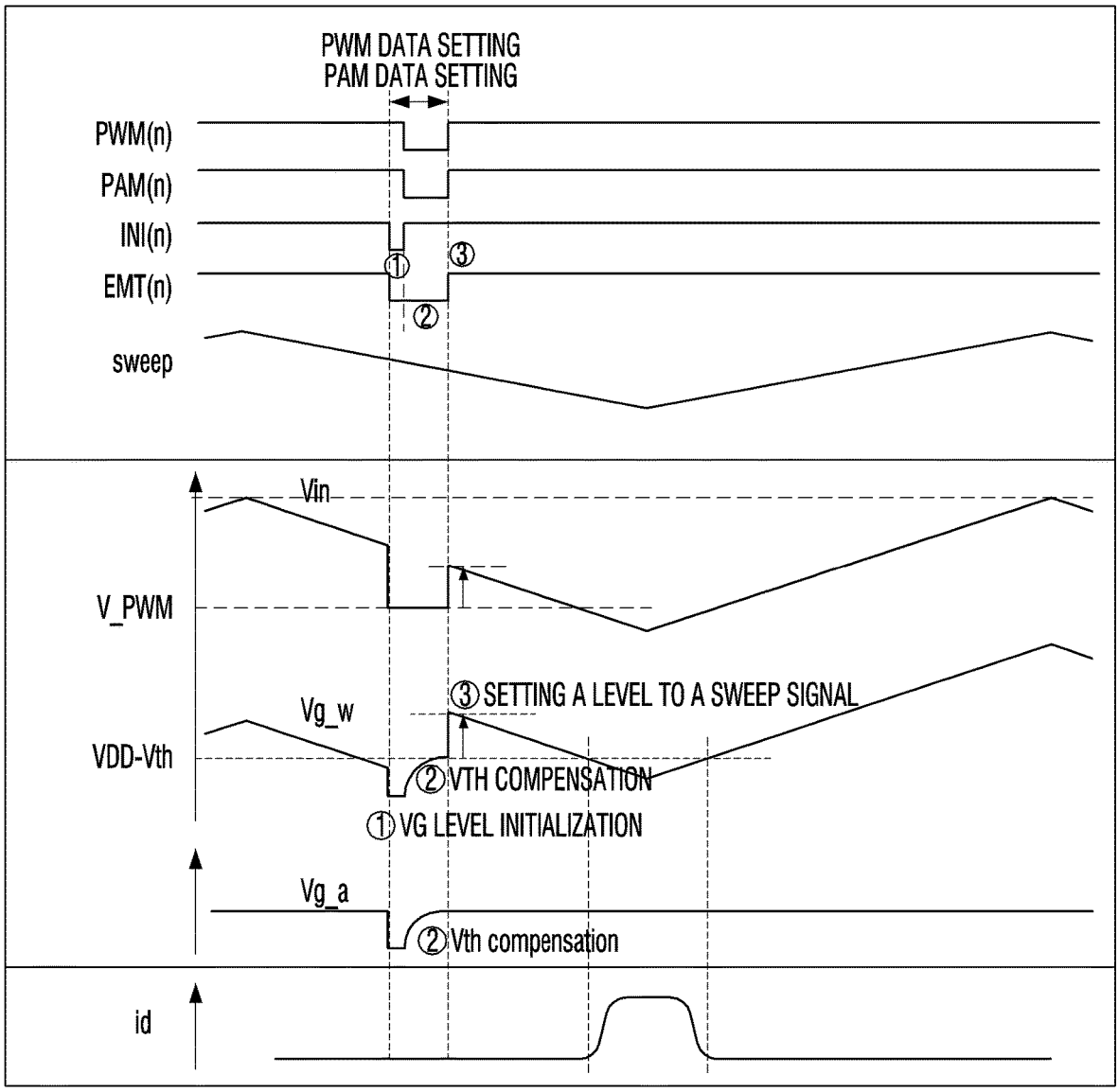
FIG. 15B is a diagram illustrating a method of driving of the sub pixel in FIG. 15A.

FIG. 15A is a circuit diagram illustrating a detailed configuration of a sub pixel wherein both of a PAM pixel circuit 140' and the PWM pixel circuit 120' included in the sub pixel of the display panel 1000 are implemented as PMOSFETs, according to embodiments. FIG. 15B is a diagram illustrating a method of driving of the sub pixel in FIG. 15A. Referring to FIG. 15B, the operation is as illustrated in FIG. 9C, except that, while PWM data is set to the PWM pixel circuit 120' in a data setting period, the PAM data is also set to the PAM pixel circuit 140'.

Figure 16A:
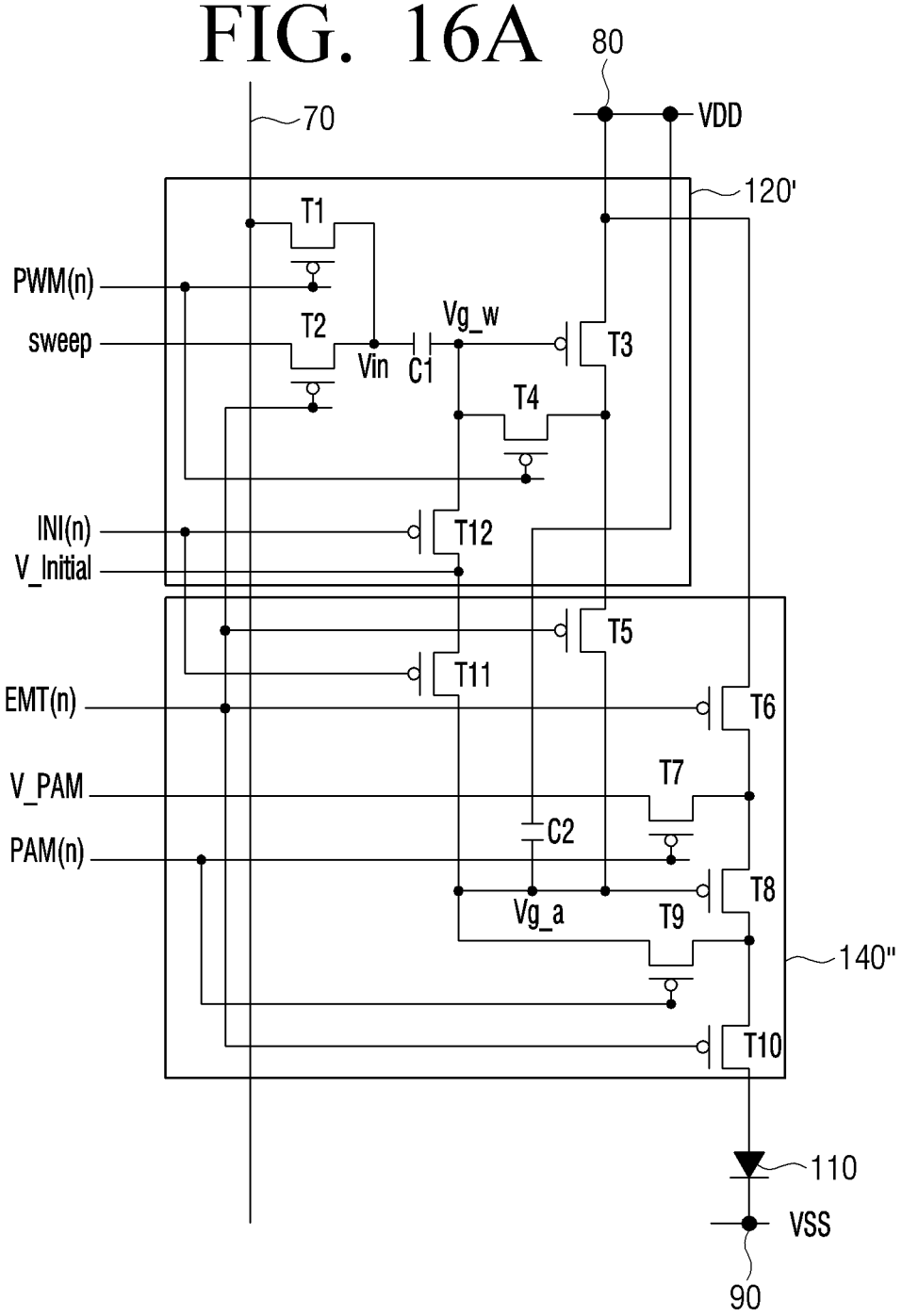
FIG. 16A is a circuit diagram illustrating another detailed configuration of a sub pixel according to embodiments.

FIG. 16A is a circuit diagram illustrating another detailed configuration of a sub pixel according to embodiments. Referring to FIG. 16A, it can be seen that the PWM pixel circuit 120' is the same as FIG. 15A, but the PAM pixel circuit 140" is constituted differently from FIG. 15A.

Figure 16B:
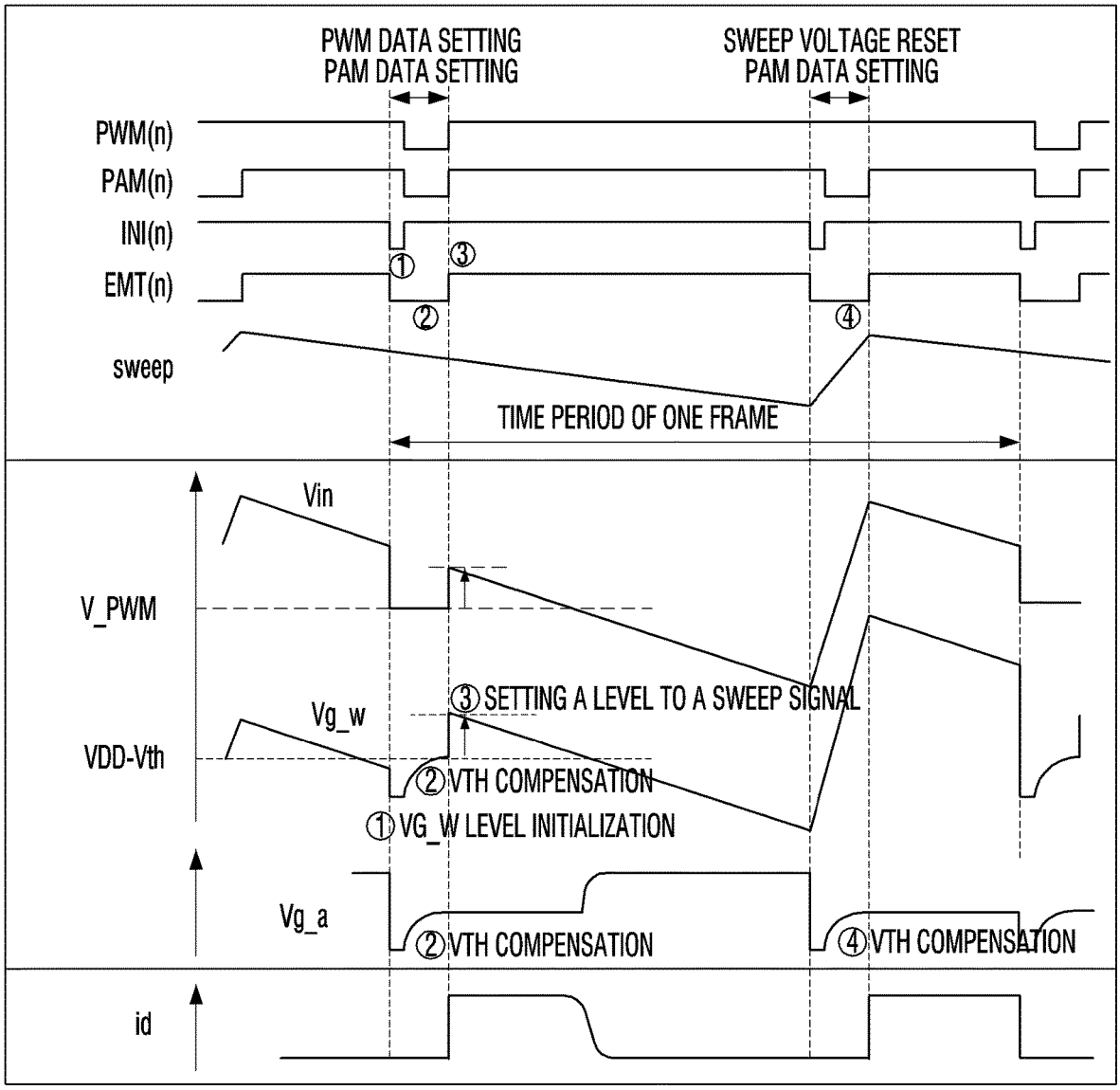
FIG. 16B is a diagram illustrating a method of driving the sub pixel in FIG. 16A.

FIG. 16B is a diagram illustrating a method of driving the sub pixel in FIG. 16A. Referring to FIG. 16B, it can be seen that the PAM data voltage is set once in a PWM data setting period, and is set again when a sweep voltage is reset, i.e., when a sweep voltage returns to the initial voltage, and is thus set twice in total.

Embodiments of a PAM pixel circuit that may be added to a sub pixel are not limited to the embodiments illustrated in FIGS. 14A, 15A, and 16A, and PAM pixel circuits by any methods are applicable.

Figure 17:
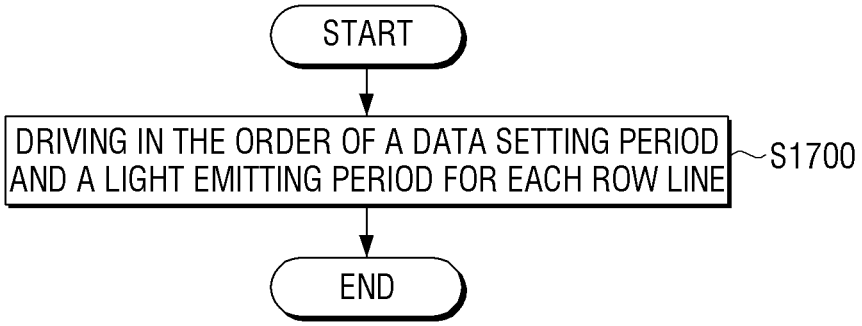
FIG. 17 is a flowchart of a driving method of a display panel, according to embodiments.

FIG. 17 is a flowchart of a driving method of the display panel 1000, according to embodiments. According to FIG. 17, the driving method of the display panel 1000 includes operation S1700 wherein, in the display panel 1000 wherein a plurality of pixels respectively including a plurality of sub pixels are arranged in the form of a matrix, PWM pixel circuits are driven in the order of a data setting period and a light emitting period for each row line.

Here, each of the plurality of sub pixels included in the display panel 1000 includes a light emitting element 110 and PWM pixel circuits 120, 120'. Here, the PWM pixel circuits 120, 120' may control the light emitting duration of the light emitting element 110 based on a PWM data voltage and a sweep voltage.

A data setting period and a light emitting period are continuous time periods, and have the same lengths for each row line. That is, when the display panel 1000 is driven, the lengths of data setting periods may be identical in all row lines, and the lengths of light emitting periods may also be identical in all row lines. Also, data setting periods may be driven sequentially for each row line of the plurality of pixels.

Accordingly, the driving method of the display panel 1000 according to embodiments may include the steps of driving PWM pixel circuits 120, 120' corresponding to the first row line of the plurality of pixels arranged in the form of a matrix in a light emitting period, and while the PWM pixel circuits 120, 120' corresponding to the first row line are driven in the light emitting period, driving the PWM pixel circuits 120, 120' corresponding to the second row line in a data setting period.

According to embodiments, the sum of a data voltage setting period and a light emitting period may be the time period of one image frame, and the total time period wherein all row lines of the display panel 1000 are driven once may be a time period exceeding the time period of one image frame. For example, the total time period wherein all row lines of the display panel 1000 are driven once may approximately be time periods of two image frames, but is not limited thereto.

According to the various embodiments of the disclosure as described above, a display panel wherein a data voltage can be stably set and a high light emission duty ratio can be secured, and a driving method of the display panel can be provided. Accordingly, low power consumption in various types of display panels including inorganic LED display panels becomes possible.

The display panel (1000) according to an embodiment of the disclosure may be applied to an electronic product or an electronic device that requires a wearable device, a portable device, a handheld device, or various displays, in a single unit. The display panel(1000) can also be applied to a display device such as a monitor for a personal computer, a TV and a large format display device such as a digital signage, an electronic display through a plurality of assembly arrangements.

The various embodiments of the disclosure may be implemented as software including instructions stored in machine-readable storage media, which can be read by machines (e.g., computers). Here, the machines refer to devices that call instructions stored in a storage medium, and can operate according to the called instructions, and the devices may include an electronic device including various display panels according to the aforementioned embodiments.

In case an instruction is executed by a processor, the processor may perform a function corresponding to the instruction by itself, or by using other components under its control. An instruction may include a code that is generated or executed by a compiler or an interpreter. A storage medium that is readable by machines may be provided in the form of a non-transitory storage medium. Here, the term 'non-transitory' only means that a storage medium does not include signals, and is tangible, but does not indicate whether data is stored in the storage medium semi-permanently or temporarily.

According to embodiments, methods according to the various embodiments described in the disclosure may be provided while being included in a computer program product. A computer program product refers to a product, and it can be traded between a seller and a buyer. A computer program product can be distributed on-line in the form of a storage medium that is readable by machines (e.g., a compact disc read only memory (CD-ROM)), or through an application store (e.g., Play Store™). In the case of on-line distribution, at least a portion of a computer program product may be stored in a storage medium such as the server of the manufacturer, the server of the application store, and the memory of the relay server at least temporarily, or may be generated temporarily.

Further, each of the components according to the various embodiments (e.g., a module or a program) may consist of a singular object or a plurality of objects. Also, among the aforementioned corresponding sub components, some sub components may be omitted, or other sub components may be further included in the various embodiments. Generally or additionally, some components (e.g., a module or a program) may be integrated as an object, and perform the functions that were performed by each of the components before integration identically or in a similar manner. A module, a program, or operations performed by other components according to the various embodiments may be executed sequentially, in parallel, repetitively, or heuristically. Or, at least some of the operations may be executed in a different order or omitted, or other operations may be added.

The descriptions above are example explanations of the technical idea of the disclosure, and various amendments and modifications may be made by those having ordinary skill in the technical field to which the disclosure belongs, within the scope of the intrinsic characteristics of the disclosure. Also, the embodiments according to the disclosure are not for limiting the technical idea of the disclosure, but for explaining the technical idea, and the scope of the technical idea of the disclosure is not limited by the embodiments. Accordingly, the scope of protection of the disclosure may be interpreted based on the appended claims, and all technical ideas within an equivalent scope thereto may be interpreted to belong to the scope of protection of the disclosure.

What is claimed is:

1. A display panel comprising:

a plurality of pixels arranged in a matrix, the plurality of pixels respectively comprising a plurality of sub pixels, wherein the plurality of sub pixels respectively comprises:

a light emitting element; and a PWM pixel circuit configured to control a light emitting duration of the light emitting element based on a pulse width modulation (PWM) data voltage and a sweep voltage, and wherein a plurality of PWM pixel circuits included in the display panel are driven, for each of row lines of the plurality of pixels, in an order of a data setting period for setting the PWM data voltage and then a light emitting period in which the light emitting element emits light during a duration corresponding to the set PWM data voltage according to a change of the sweep voltage, wherein the data setting period and the light emitting period are continuous in time, and wherein the data setting period is driven sequentially for each of the row lines.

2. The display panel of claim 1, wherein, while a plurality of PWM pixel circuits corresponding to a first row line of the plurality of pixels operates in the light emitting period, a plurality of PWM pixel circuits corresponding to a second row line of the plurality of pixels operates in the data setting period.

3. The display panel of claim 1, wherein a sum of a time period of the data voltage setting period and a time period of the light emitting period is a time period of one image frame, and wherein a total time period in which all row lines of the plurality of pixels are driven once exceeds the time period of the one image frame.

4. The display panel of claim 1, wherein the PWM pixel circuit comprises a control transistor configured to be turned on and off, based on the PWM data voltage and the sweep voltage, to control the light emitting duration of the light emitting element based on a turning-on and off operation of the control transistor, wherein a gate terminal voltage of the control transistor is set as a first voltage, based on the PWM data voltage and the sweep voltage during the data setting period, and wherein the gate terminal voltage of the control transistor changes according to the change of the sweep voltage during the light emitting period, so that the control transistor is turned on during a time period corresponding to the PWM data voltage.

5. The display panel of claim 4, wherein the control transistor is an N-channel metal oxide semiconductor field effect transistor (NMOSFET), and a source terminal of the control transistor is connected to a ground voltage terminal, and wherein the PWM pixel circuit further comprises:

a first transistor connected between a drain terminal of the first transistor and a gate terminal of the control transistor;

a first capacitor comprising a first end connected to the drain terminal of the first transistor and the gate terminal of the control transistor;

a second transistor comprising:

a drain terminal connected to a data line to which the PWM data voltage is applied; and a source terminal connected to a second end of the first capacitor;

a third transistor comprising:

a source terminal connected to the drain terminal of the first transistor, the gate terminal of the control transistor, and the first end of the first capacitor; and a drain terminal to which an initial voltage is applied;

a fourth transistor comprising:

a drain terminal to which the sweep voltage is applied; and a source terminal connected to the second end of the first capacitor and the source terminal of the second transistor; and a fifth transistor comprising:

a drain terminal connected to a cathode terminal of the light emitting element; and a source terminal connected to the source terminal of the first transistor and the drain terminal of the control transistor, and wherein an anode terminal of the light emitting element is connected to a driving voltage terminal.

6. The display panel of claim 5, wherein the gate terminal voltage of the control transistor in the data setting period:

becomes the initial voltage through the third transistor being turned on based on a second driving signal, while the fourth transistor is turned off based on a first driving signal;

becomes a second voltage from the initial voltage, while the third transistor is turned off based on the second driving signal and the first transistor and the second transistor are turned on based on a third driving signal; and is set as the first voltage from the second voltage, based on the first transistor and the second transistor being turned off according to the third driving signal and the fourth transistor being turned on according to the first driving signal, wherein the first voltage is reduced from the second voltage as much as a difference value between the PWM data voltage and a sweep voltage at a time point when the fourth transistor is turned on, and wherein the second voltage is a sum of a ground voltage of the ground voltage terminal and a threshold voltage of the control transistor.

7. The display panel of claim 6, wherein the fourth transistor is configured to, in the light emitting period, maintain a turned-on state, based on the first driving signal, and wherein the gate terminal voltage of the control transistor, in the light emitting period, changes from the first voltage, based on the sweep voltage applied through the turned-on fourth transistor.

8. The display panel of claim 7, wherein the control transistor is configured to, in the light emitting period, be turned on in a time in which a gate voltage of the gate terminal that changes based on the sweep voltage is higher than the second voltage, and wherein the light emitting element is configured to, in the light emitting period, emit light, based on a driving current that flows through the control transistor while the control transistor is turned on.

9. The display panel of claim 6, wherein the PWM pixel circuit further comprises a constant current source configured to provide a driving current of a regular amplitude to the light emitting element, and wherein the drain terminal of the fifth transistor is connected with the cathode terminal of the light emitting element through the constant current source, and the fifth transistor is turned on during the light emitting period according to the first driving signal.

10. The display panel of claim 5, wherein the drain terminal of the third transistor is connected with the data line, and wherein the initial voltage is the PWM data voltage.

11. The display panel of claim 4, wherein the control transistor is a P-channel metal oxide semiconductor field effect transistor (PMOSFET), and a source terminal of the control transistor is connected to a driving voltage terminal, and wherein the PWM pixel circuit further comprises:

a sixth transistor connected between a drain terminal and a gate terminal of the control transistor;

a second capacitor comprising a first end connected to a source terminal of the sixth transistor and the gate terminal of the control transistor;

a seventh transistor comprising:

a source terminal connected to a data line to which the PWM data voltage is applied; and a drain terminal connected to a second end of the second capacitor;

an eighth transistor comprising:

a drain terminal connected to the source terminal of the sixth transistor, the gate terminal of the control transistor, and the first end of the second capacitor; and a source terminal to which an initial voltage is applied;

a ninth transistor comprising:

a source terminal to which the sweep voltage is applied; and a drain terminal connected to the second end of the second capacitor and the drain terminal of the seventh transistor; and a tenth transistor comprising:

a drain terminal connected to an anode terminal of the light emitting element; and a source terminal connected to the drain terminal of the sixth transistor and the drain terminal of the control transistor, and wherein a cathode terminal of the light emitting element is connected to a ground voltage terminal.

12. The display panel of claim 11, wherein the gate terminal voltage of the control transistor in the data setting period:

becomes the initial voltage through the eighth transistor being turned on based on a fifth driving signal, while the ninth transistor is turned off based on a fourth driving signal;

becomes a third voltage from the initial voltage, while the eighth transistor is turned off based on the fifth driving signal and the sixth transistor and the seventh transistor are turned on based on a sixth driving signal; and is set as the first voltage from the third voltage, based on the sixth transistor and the seventh transistor being turned off according to the sixth driving signal and the ninth transistor being turned on according to the fourth driving signal, wherein the first voltage is raised from the third voltage as much as a difference value between the PWM data voltage and a sweep voltage at a time point when the ninth transistor is turned on, and wherein the third voltage is a value of subtracting a threshold voltage of the control transistor from a driving voltage of the driving voltage terminal.

13. The display panel of claim 12, wherein the ninth transistor is configured to, in the light emitting period, maintain a turned-on state, based on the fourth driving signal, and wherein the gate terminal voltage of the control transistor, in the light emitting period, changes from the first voltage, based on the sweep voltage applied through the turned-on ninth transistor.

14. The display panel of claim 13, wherein the control transistor is configured to, in the light emitting period, be turned on in a time period in which a gate voltage of the gate terminal that changes based on the sweep voltage is lower than the third voltage, and wherein the light emitting element is configured to, in the light emitting time period, emit light, based on a driving current that flows through the control transistor while the control transistor is turned on.

15. The display panel of claim 1, further comprising a pulse amplitude modulation (PAM) driving circuit configured to control an amplitude of a driving current that is provided to the light emitting element, based on a PAM data voltage.

16. The display panel of claim 1, wherein the sweep voltage is a periodic signal in one time period of one image frame, and continuously changes during the one time period.

17. A driving method of a display panel comprising a plurality of pixels arranged in a matrix, the plurality of pixels respectively comprising a plurality of sub pixels respectively, wherein the plurality of sub pixels respectively comprises:

a light emitting element; and a PWM pixel circuit configured to control a light emitting duration of the light emitting element, based on a pulse width modulation (PWM) data voltage and a sweep voltage, and wherein the driving method comprises:

driving a plurality of PWM pixel circuits included in the display panel, for each of row lines of the plurality of pixels, in an order of a data setting period for setting the PWM data voltage and then a light emitting period in which the light emitting element emits light during a duration corresponding to the set PWM data voltage according to a change of the sweep voltage, and wherein the data setting period and the light emitting period are continuous in time, and wherein the data setting period is driven sequentially for each of the row lines.

18. The driving method of claim 17, wherein the driving comprises:

driving a plurality of PWM pixel circuits corresponding to a first row line of the plurality of pixels, in the light emitting period; and while the plurality of PWM pixel circuits corresponding to the first row line are driven in the light emitting period, driving a plurality of PWM pixel circuits corresponding to a second row line of the plurality of pixels in the data setting period.

19. The driving method of claim 17, wherein a sum of a time period of the data voltage setting period and a time period of the light emitting period is a time period of one image frame, and wherein a total time period in which all row lines of the plurality of pixels are driven once exceeds the time period of the one image frame.

20. A display panel comprising:

a plurality of pixels arranged in a matrix, the plurality of pixels respectively comprising a plurality of sub pixels, wherein the plurality of sub pixels comprises:

a first plurality of light emitting elements in a first row line of the plurality of pixels;

a first PWM pixel circuit configured to, based on a change of a sweep voltage:

set a pulse width modulation (PWM) data voltage in a first time period; and control the first plurality of light emitting elements to emit first light in a second time period corresponding to the PWM data voltage set in the first time period, the second time period being continuously after the first time period;

a second plurality of light emitting elements in a second row line of the plurality of pixels;

a second PWM pixel circuit configured to, while the first plurality of light emitting elements are being controlled to emit the first light in the second time period:

set the PWM data voltage in a third time period; and control the second plurality of light emitting elements to emit second light in a fourth time period corresponding to the PWM data voltage set in the third time period, the fourth time period being continuously after the third time period.

* * * * *